US012460908B1

(12) United States Patent
Lysdahl

(10) Patent No.: US 12,460,908 B1
(45) Date of Patent: Nov. 4, 2025

(54) HUNTING GAME TRACKING SYSTEM

(71) Applicant: Phillip Rodney Lysdahl, Anoka, MN (US)

(72) Inventor: Phillip Rodney Lysdahl, Anoka, MN (US)

( * ) Notice: Subject to any disclaimer, the term of this patent is extended or adjusted under 35 U.S.C. 154(b) by 0 days.

(21) Appl. No.: 18/805,913

(22) Filed: Aug. 15, 2024

(51) Int. Cl.
*F42B 6/04* (2006.01)
*F42B 12/36* (2006.01)
*F42B 12/38* (2006.01)

(52) U.S. Cl.
CPC ..... *F42B 12/385* (2013.01); *F42B 12/362* (2013.01)

(58) Field of Classification Search
CPC ..... F42B 12/385; F42B 6/08; F42B 12/40; F42B 6/04; F42B 12/362; F42B 12/365; F42B 12/56; F41B 5/1438; F41G 1/467; Y10T 29/49826; Y10T 29/49876; H04W 4/029; A01M 31/00; G01S 19/19; A01K 11/008
See application file for complete search history.

(56) References Cited

U.S. PATENT DOCUMENTS 6,409,617 B1 6/2002 Armold
6,856,250 B2 2/2005 Hilliard
7,232,389 B2 6/2007 Monteleone
7,632,199 B2 12/2009 Kikos
8,192,309 B1 6/2012 Roberts
8,425,354 B2 * 4/2013 Ferguson ..... F42B 12/365 473/578
11,549,792 B2 1/2023 Hogan
11,835,324 B2 * 12/2023 Hawkins ..... F42B 12/362
2013/0072331 A1 * 3/2013 Goodwin ..... F42B 6/08 473/570
2017/0241756 A1 8/2017 White, Jr.
2018/0142996 A1 * 5/2018 Wetzler ..... F42B 12/385
2021/0223013 A1 * 7/2021 Pulice ..... F42B 12/40

* cited by examiner

*Primary Examiner* — Dionne Pendleton

(57) ABSTRACT

A hunting game tracking system for tracking a location of an injured game animal includes an arrowhead having an aft end, a tip end, and a ferrule extending therebetween. A tracker housing releasably coupled to the arrowhead has a front side, a back side, and an upper end that is angled to extend outwardly from the front side and downwardly toward the back side. A transmitter wirelessly communicates with a GPS unit to identify a location of the tracker housing. An ejector is movably positioned within the ferrule. The tracker housing is positionable within a cutout extending into the ejector. The cutout includes a sloped upper wall that is in contact with the upper end of the tracker housing and that slides downwardly against the upper end of the tracker housing to urge the tracker housing outwardly from the arrowhead into the animal after impact.

18 Claims, 18 Drawing Sheets

HUNTING GAME TRACKING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to broadheads and more particularly pertains to a new broadhead for tracking a location of an injured game animal.

(2) Description of Related Art Including Information Disclosed Under 37 CFR 1.97 and 1.98

The prior art relates to broadheads. Broadheads are a type of arrowhead which can be used in big game hunting. Broadheads are designed to penetrate deeply into targeted game animals, cutting vital organs to humanely and quickly kill the animal. However, the animal can run away from the hunter after being injured by the broadhead. In such circumstances, the animal may be difficult, or impossible, to locate again. The animal is thus left injured, and the hunter is unable to recover their kill. Thus, the prior art has disclosed some broadheads with tracking devices that are meant to facilitate the hunters in locating the broadheads after the arrow has been shot. However, such tracking devices are often embedded within the broadhead. Thus, when the broadhead and arrow pass completely through the targeted animal, the tracking devices are unable to facilitate the hunter in locating the injured animal. Accordingly, there is a need for a tracking device which can be ejected from the broadhead and embedded within the animal, to facilitate the hunter in locating the injured animal after it is shot with the arrow.

BRIEF SUMMARY OF THE INVENTION

An embodiment of the disclosure meets the needs presented above by generally comprising an arrowhead having an aft end, a tip end, and a ferrule extending between the aft end and the tip end. The tip end is removably couplable to an arrow tip. A tracker is releasably coupled to the arrowhead wherein the tracker is configured to be released from the arrowhead when the arrowhead impacts an animal. The tracker includes a tracker housing having a front side, a back side, and an upper end. The upper end is angled to extend outwardly from the front side and downwardly toward the back side. A transmitter is coupled to the tracker housing. The transmitter is configured to wirelessly communicate with a global positioning system unit wherein the transmitter is configured to identify a geographic location of the tracker housing and wherein the tracker is configured to facilitate locating the animal using the geographic location of the tracker housing.

An ejector is movably positioned within the ferrule wherein movement of the ejector within the ferrule releases the tracker from the arrowhead. The ejector includes an ejector top end that is positioned adjacent to the tip end of the arrowhead. A cutout is positioned adjacent to the ejector top end. The cutout has a shape that is complementary to a shape of the tracker housing wherein the tracker housing is positionable within the cutout. The cutout includes a sloped upper wall that is angled to complement the upper end of the tracker housing wherein the sloped upper wall is in contact with the upper end of the tracker housing and wherein the sloped upper wall is configured to slide downwardly against the upper end of the tracker housing to urge the tracker housing outwardly from the arrowhead into the animal when the arrowhead impacts the animal.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
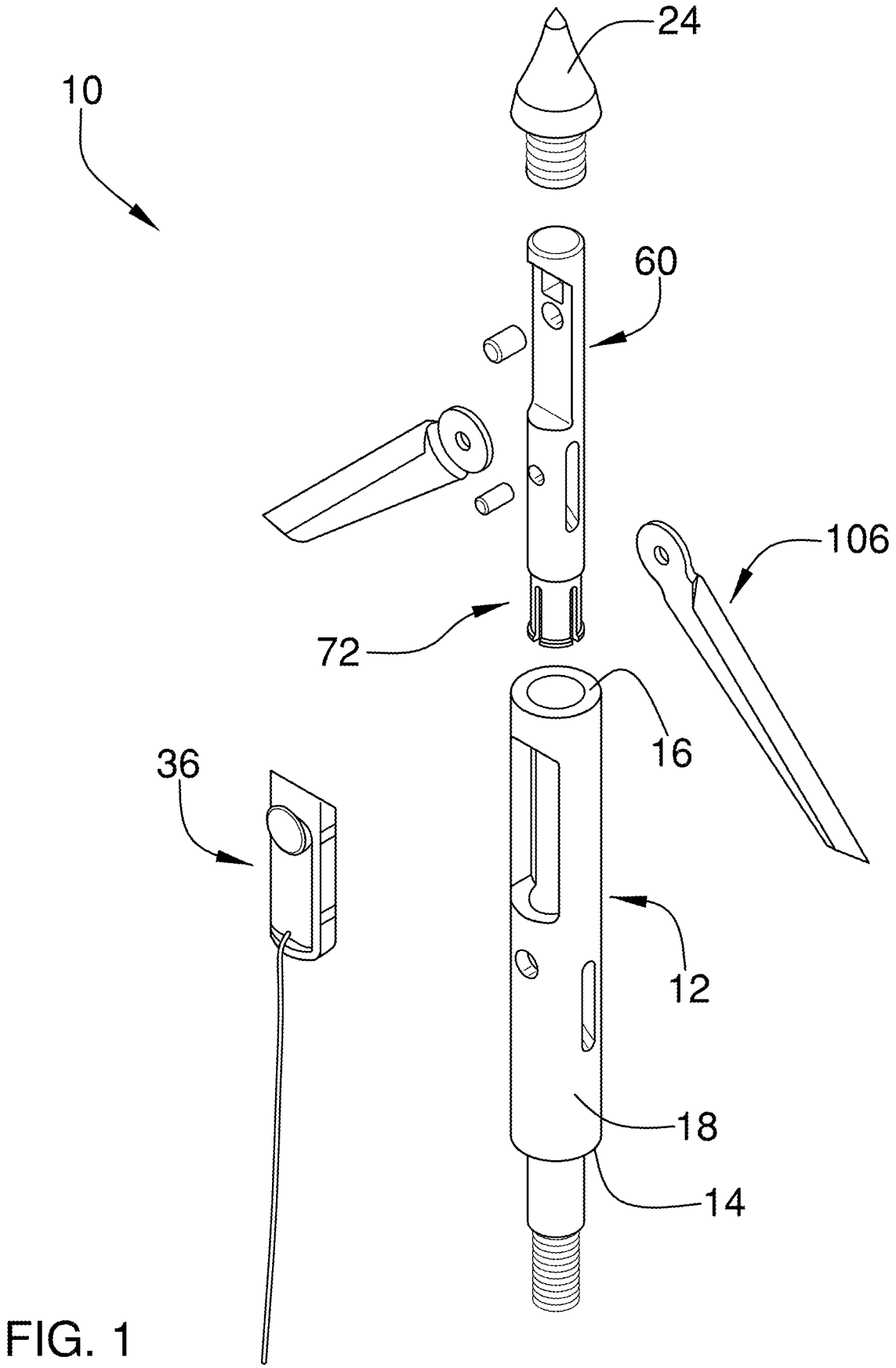
FIG. 1 is an exploded view of a hunting game tracking system according to an embodiment of the disclosure.
Figure 2:
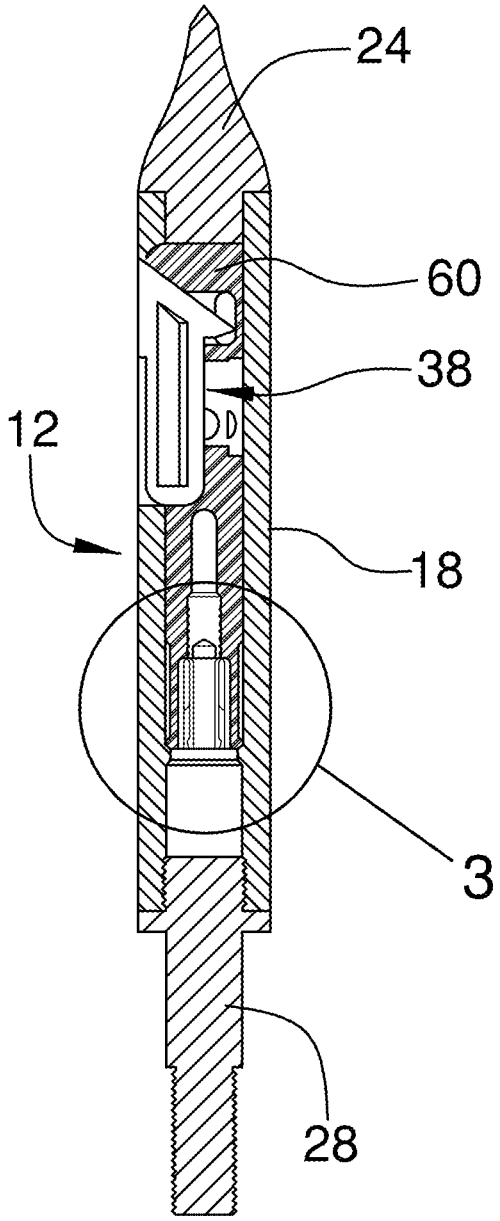
FIG. 2 is a cross-sectional view of an embodiment of the disclosure.
Figure 3A:
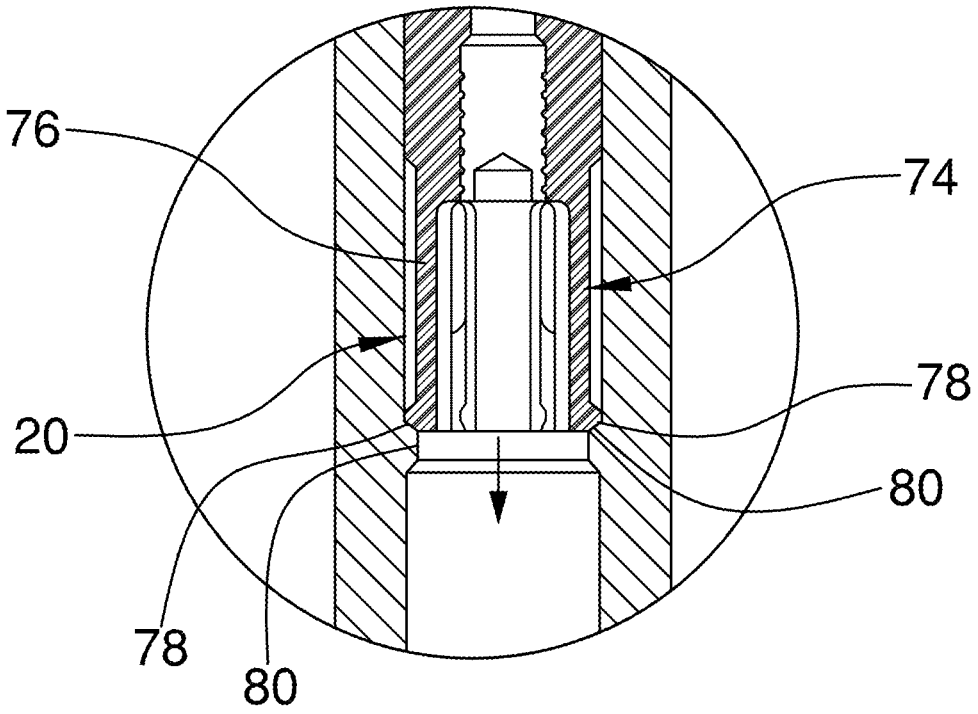
FIG. 3A is a detail cross-sectional view of an embodiment of the disclosure.
Figure 3B:
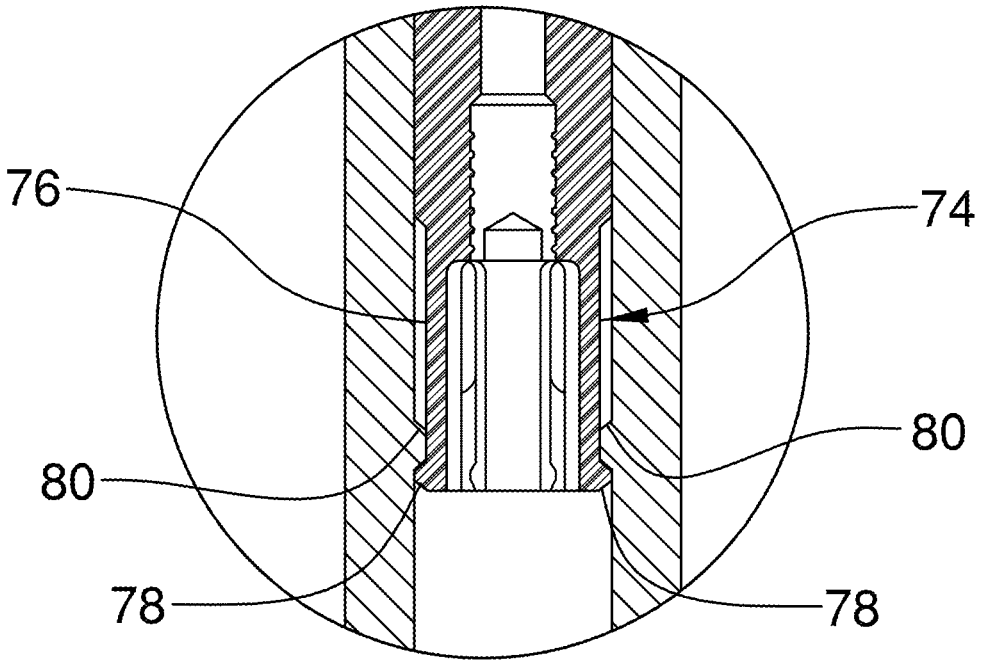
FIG. 3B is a detail cross-sectional view of an embodiment of the disclosure.
Figure 4A:
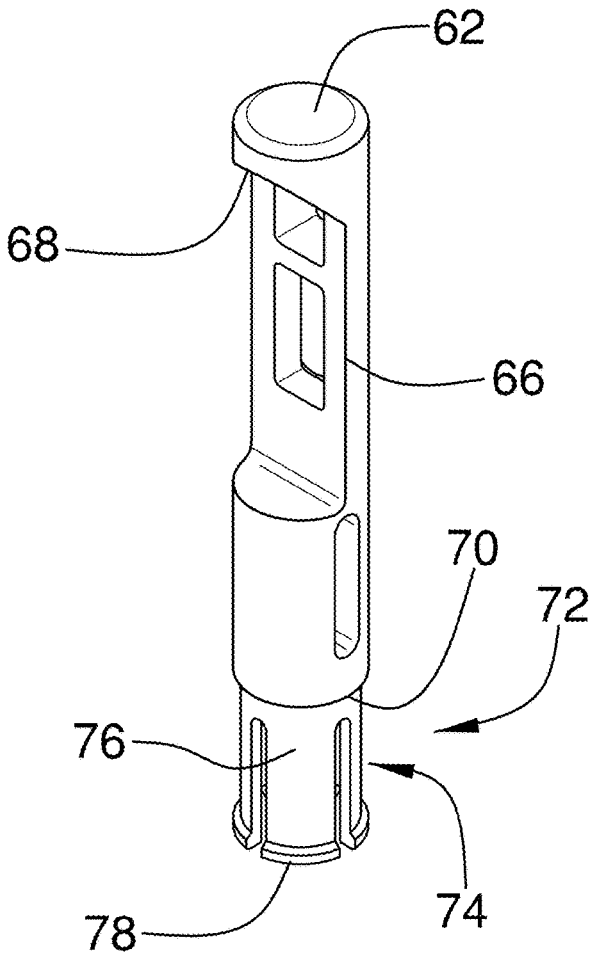
FIG. 4A is a perspective view of an embodiment of the disclosure.
Figure 4B:
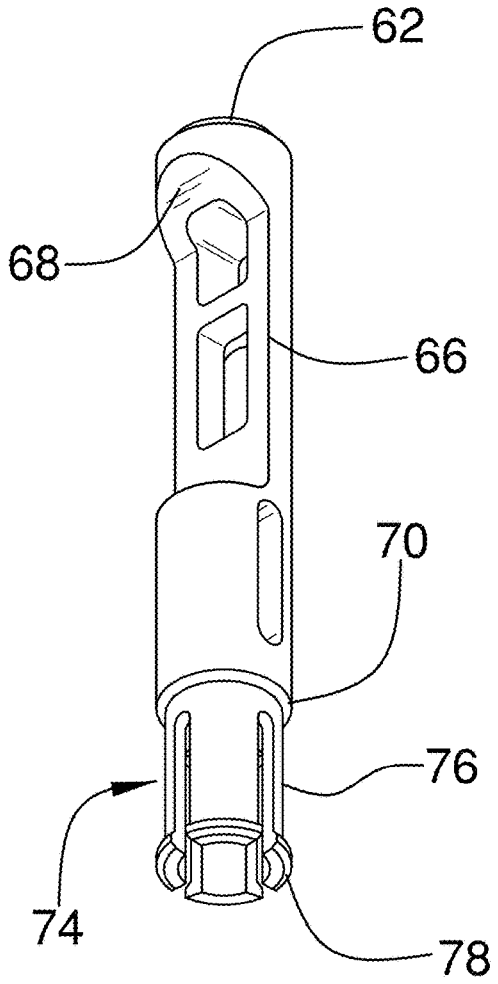
FIG. 4B is an isometric view of an embodiment of the disclosure.
Figure 5A:
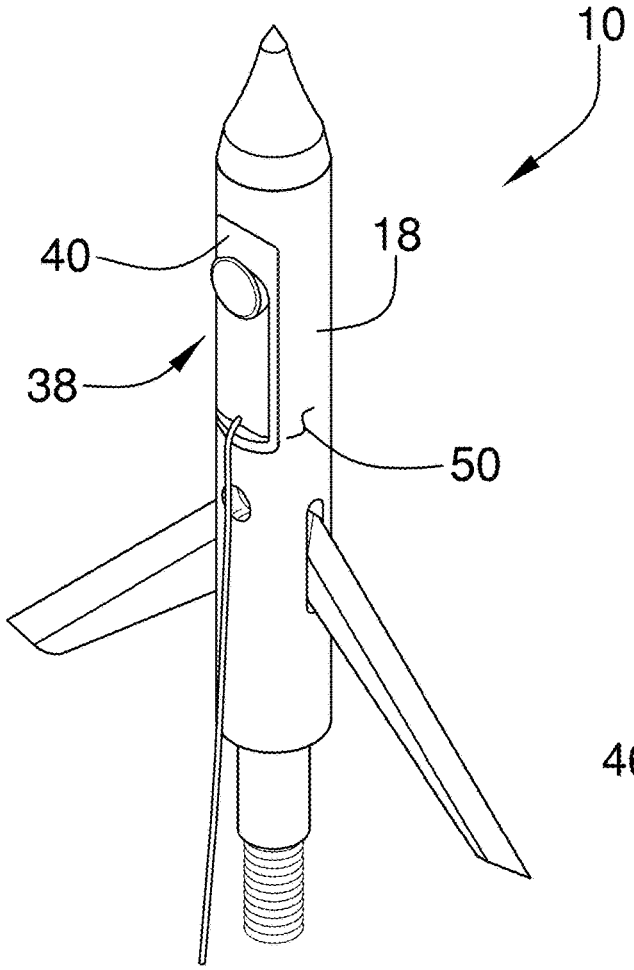
FIG. 5A is an isometric view of an embodiment of the disclosure.
Figure 5B:
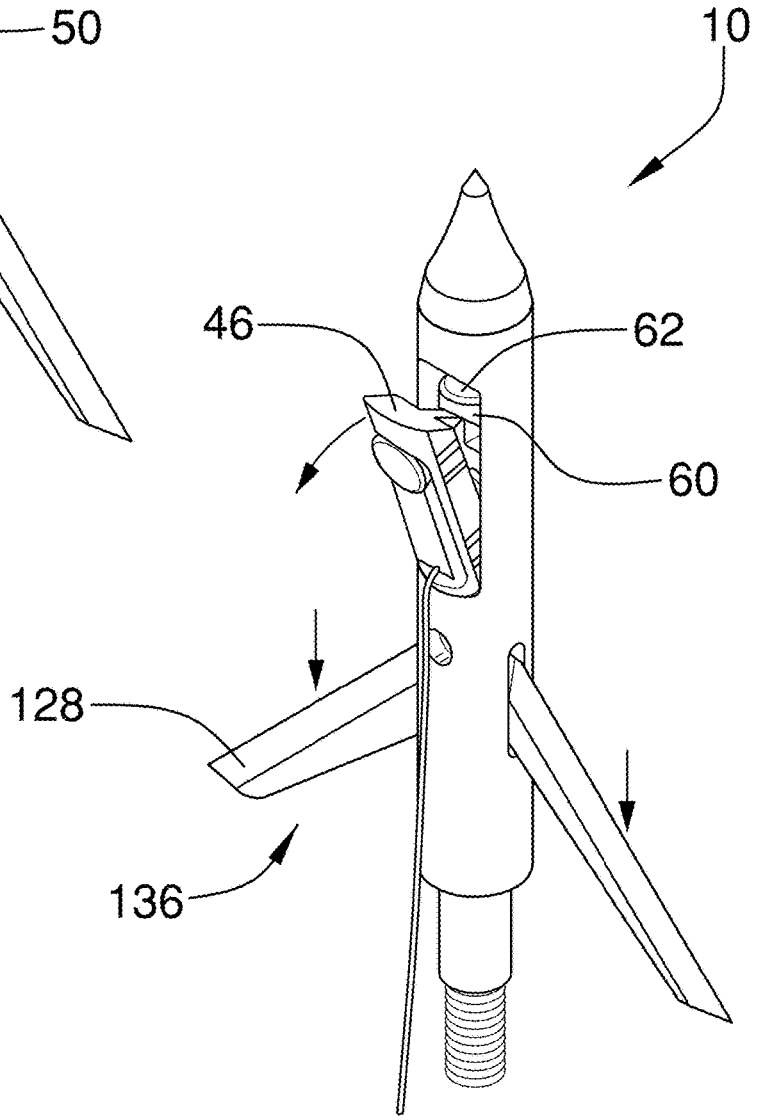
FIG. 5B is an isometric view of an embodiment of the disclosure.
Figure 6:
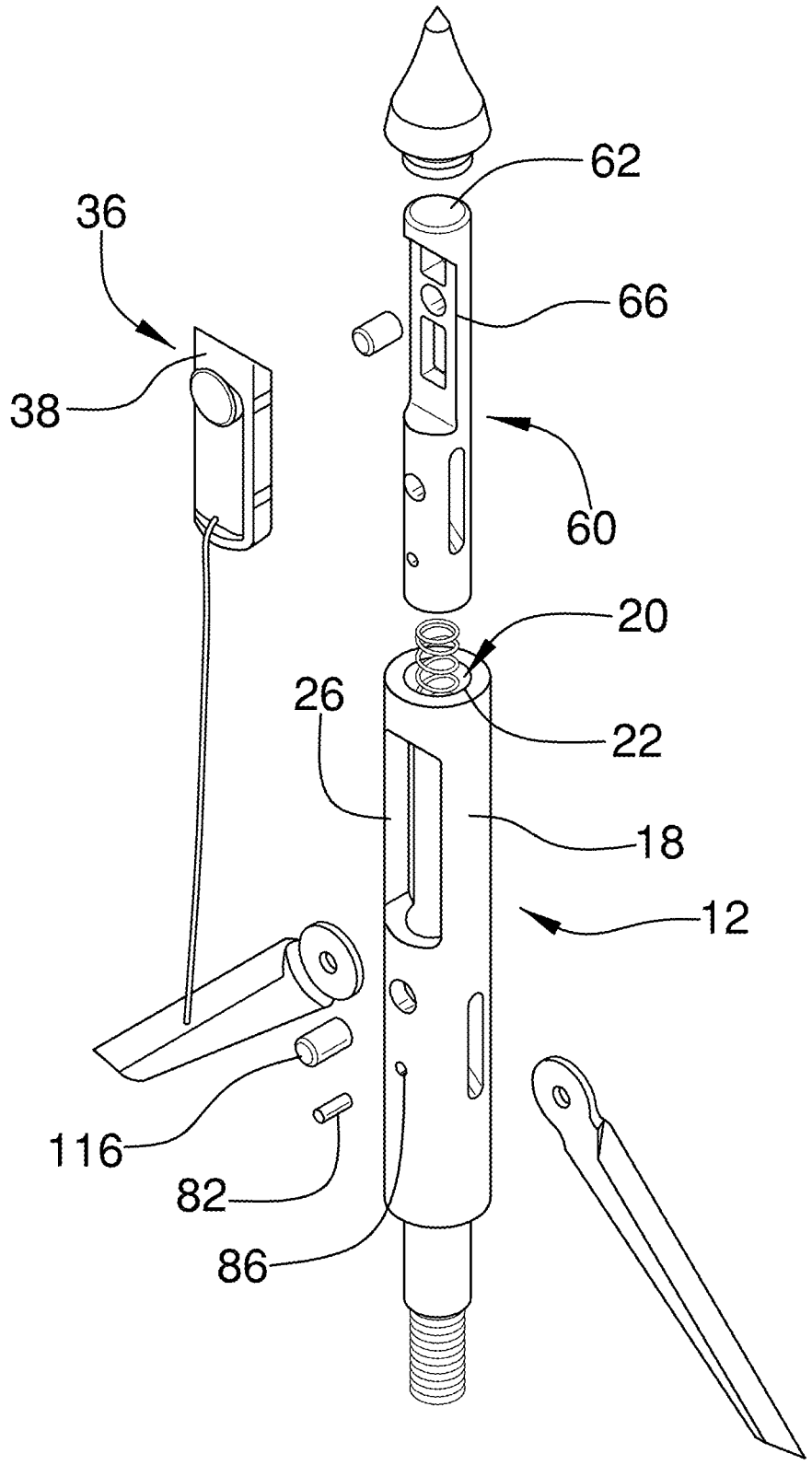
FIG. 6 is an exploded view of an embodiment of the disclosure.
Figure 7:
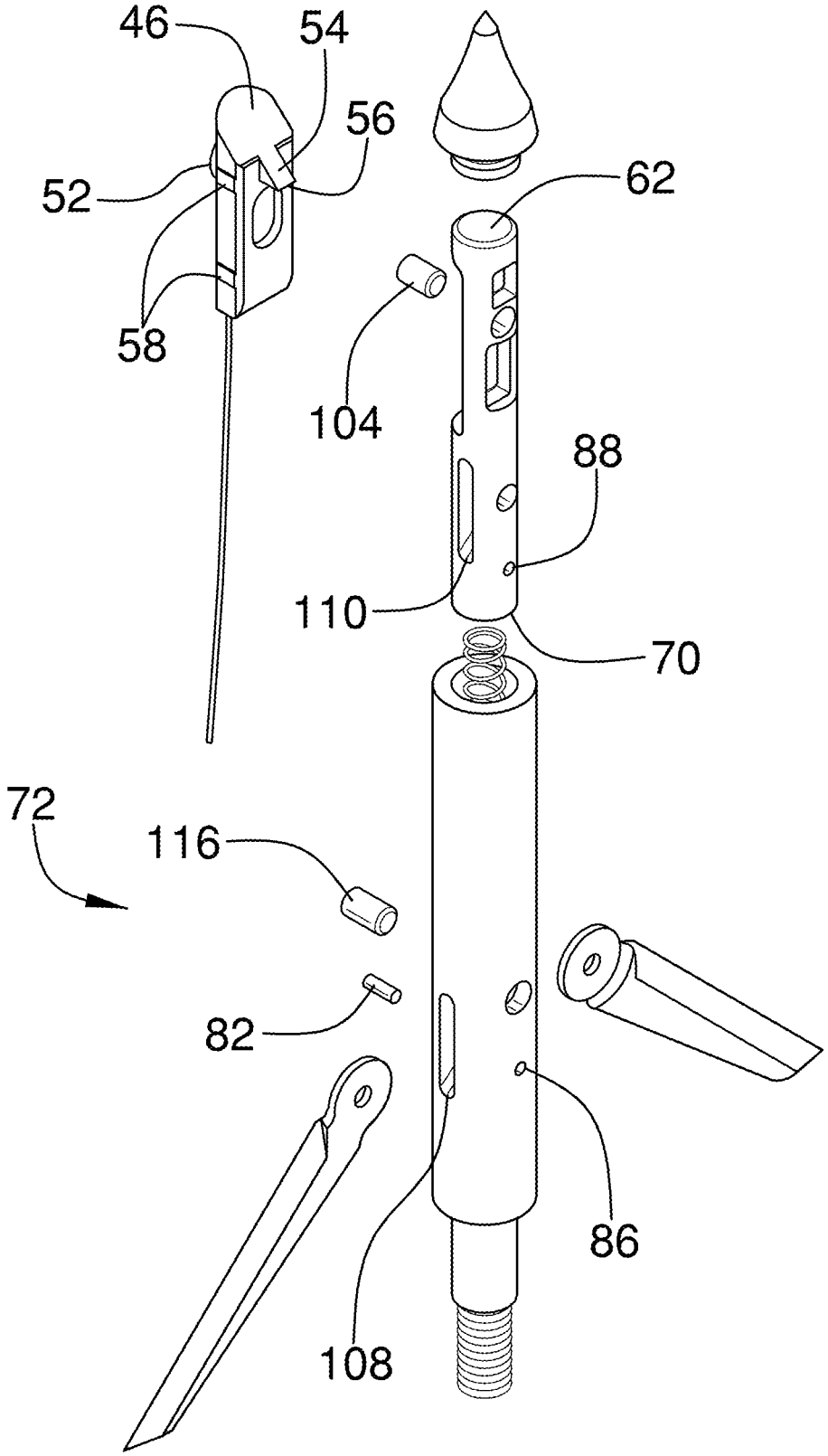
FIG. 7 is an exploded view of an embodiment of the disclosure.
Figure 8:
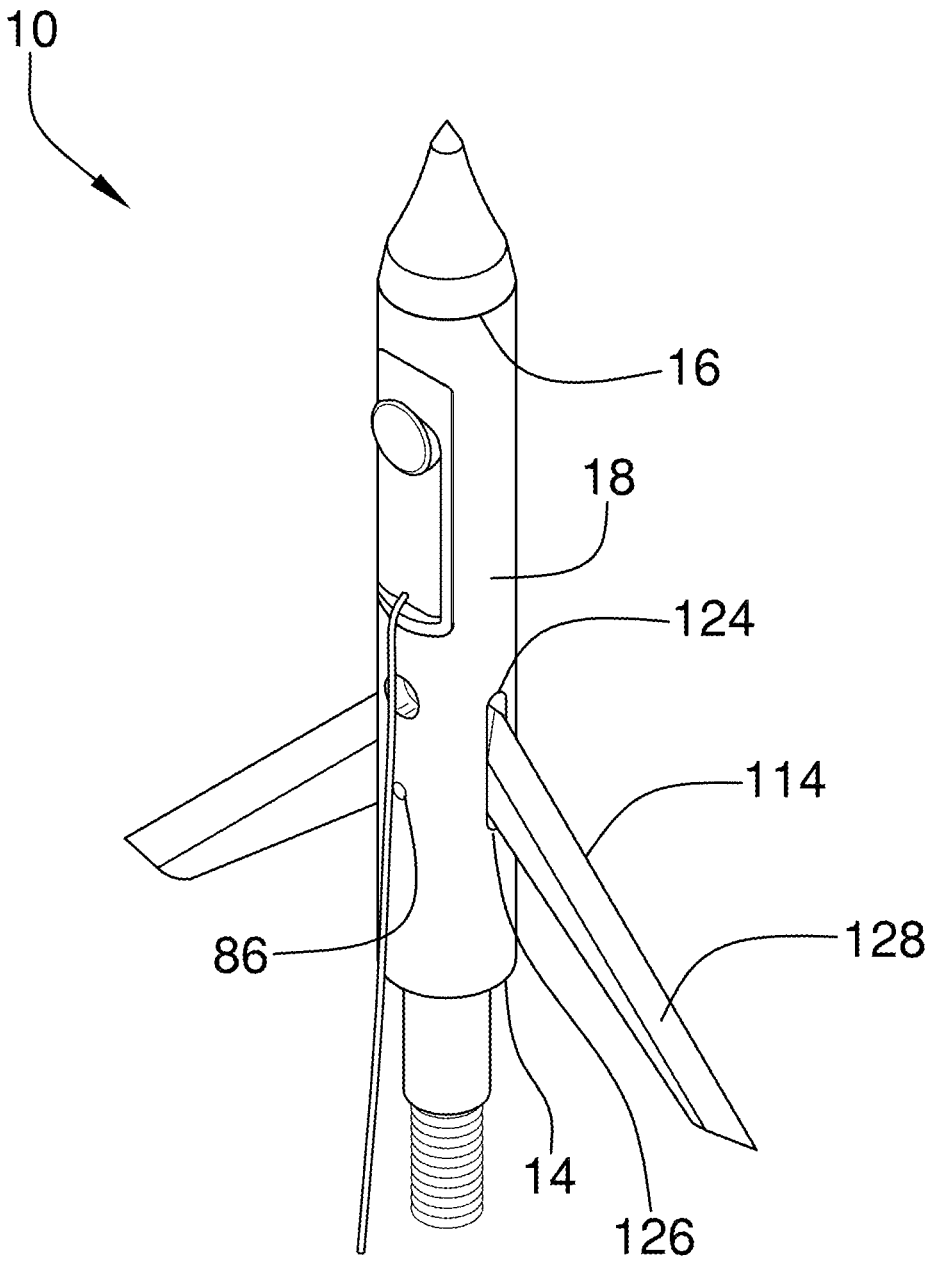
FIG. 8 is an isometric view of an embodiment of the disclosure.
Figure 9:
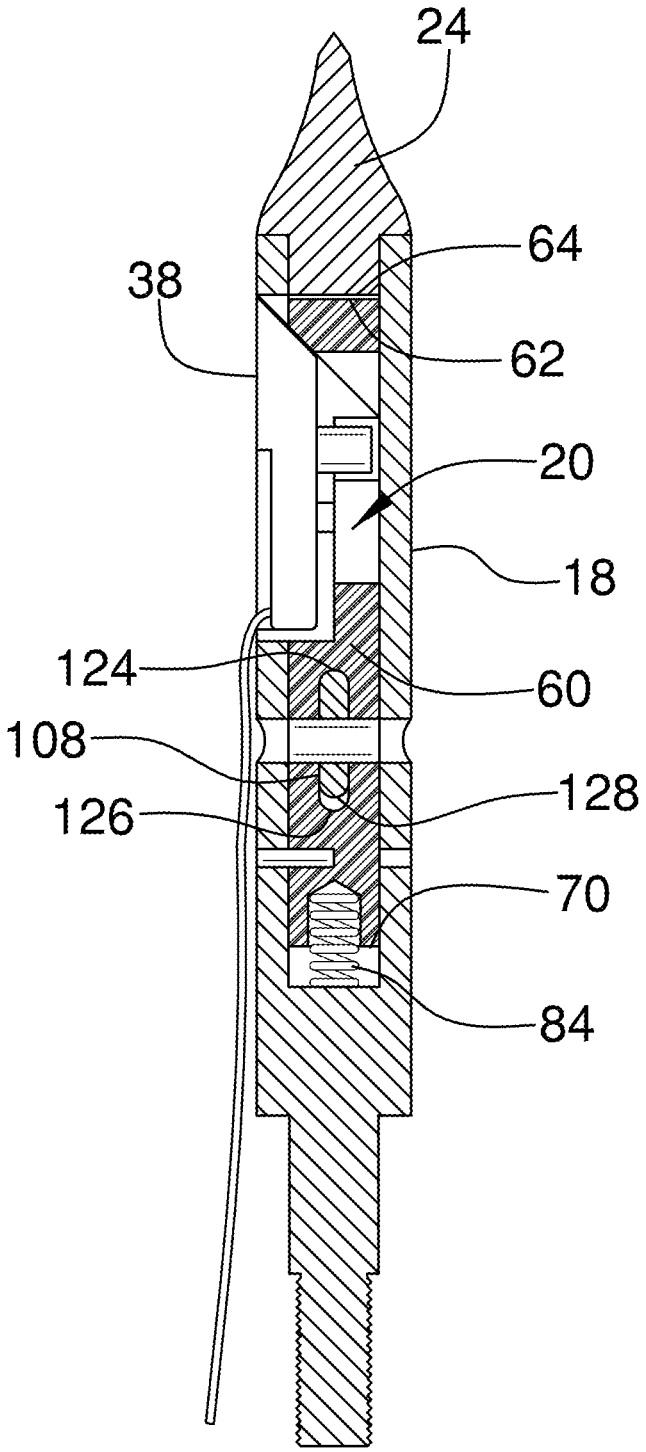
FIG. 9 is a cross-sectional view of an embodiment of the disclosure.

With reference now to the drawings, and in particular to FIGS. 1 through 20 thereof, a new broadhead embodying the principles and concepts of an embodiment of the disclosure and generally designated by the reference numeral 10 will be described.

As best illustrated in FIGS. 1 through 20, the hunting game tracking system 10 generally comprises an arrowhead 12 that has an aft end 14, a tip end 16, and a ferrule 18 extending between the aft end 14 and the tip end 16 to define an arrowhead interior space 20. The tip end 16 is removably couplable to an arrow tip 24. For example, the tip end 16 may be threaded complementarily to a threading on the arrow tip 24 to enable the arrow tip 24 to be threadably coupled to the arrowhead 12. The ferrule 18 is generally cylindrical. The arrowhead 12 may comprise a broadhead wherein the arrowhead 12 is configured for big game hunting. The arrowhead 12 may comprise a high tensile strength, light weight material, such as aluminum.

The arrowhead 12 may further include a tip end opening 22 that extends through the tip end 16 into the arrowhead interior space 20. The tip end opening 22 generally has a size that is complementary to a size of the arrow tip 24 wherein the tip end opening 22 is configured to receive the arrow tip 24. The arrow tip 24 is generally positionable within the tip end opening 22 to selectively cover the tip end opening 22.

A tracker slot 26 may extend through an outer surface 50 of the ferrule 18 into the arrowhead interior space 20. The tracker slot 26 is generally positioned proximate to the tip end 16 of the arrowhead 12.

A pair of ferrule actuator slots 108 may extend through the outer surface 50 of the ferrule 18 into the arrowhead interior space 20. The pair of ferrule actuator slots 108 may be aligned with each other on opposing sides of the ferrule 18. For example, the pair of ferrule actuator slots 108 may be fluidly coupled together to define a continuous ferrule actuator channel that extends through the ferrule 18. Specifically, the pair of ferrule actuator slots 108 may be horizontally parallel to each other across a transverse axis extending across the ferrule 18. In certain embodiments, the pair of ferrule actuator slots 108 may be vertically offset from each other along a longitudinal axis of the ferrule 18. The longitudinal axis may also be referred to as the length of the ferrule 18 and is generally measured between the aft end 14 and the tip end 16 of the arrowhead 12. The transverse axis may also be referred to as the diameter, or width, of the ferrule 18 and is generally perpendicular to the transverse axis.

The pair of ferrule actuator slots 108 may be positioned between the tracker slot 26 and the aft end 14 of the arrowhead 12. Each ferrule actuator slot of the pair of ferrule actuator slots 108 generally includes a ferrule actuator slot top end 124 and a ferrule actuator slot bottom end 126. The ferrule actuator slot bottom end 126 may be positioned proximate to the aft end 14, wherein the ferrule actuator slot bottom end 126 is positioned between the ferrule actuator slot top end 124 and the aft end 14 of the arrowhead.

Figure 10:
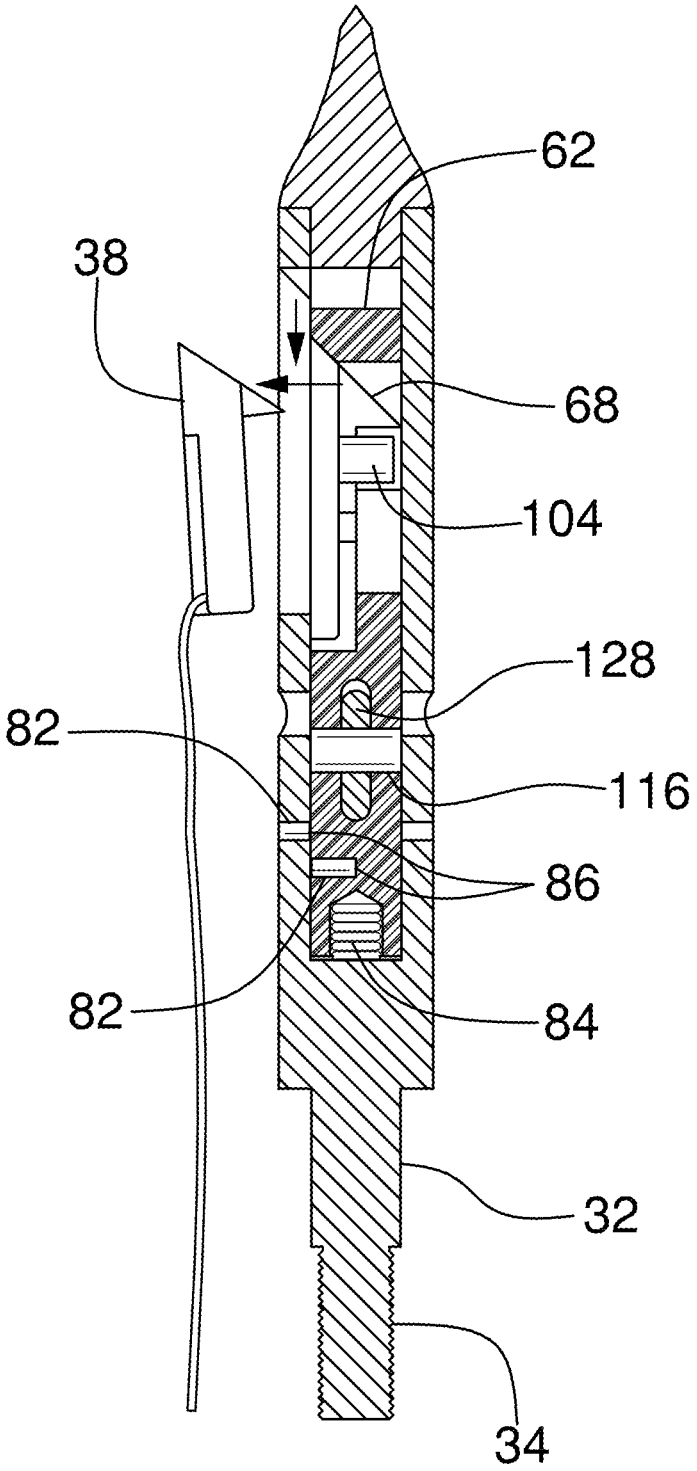
FIG. 10 is a cross-sectional view of an embodiment of the disclosure.
Figure 11:
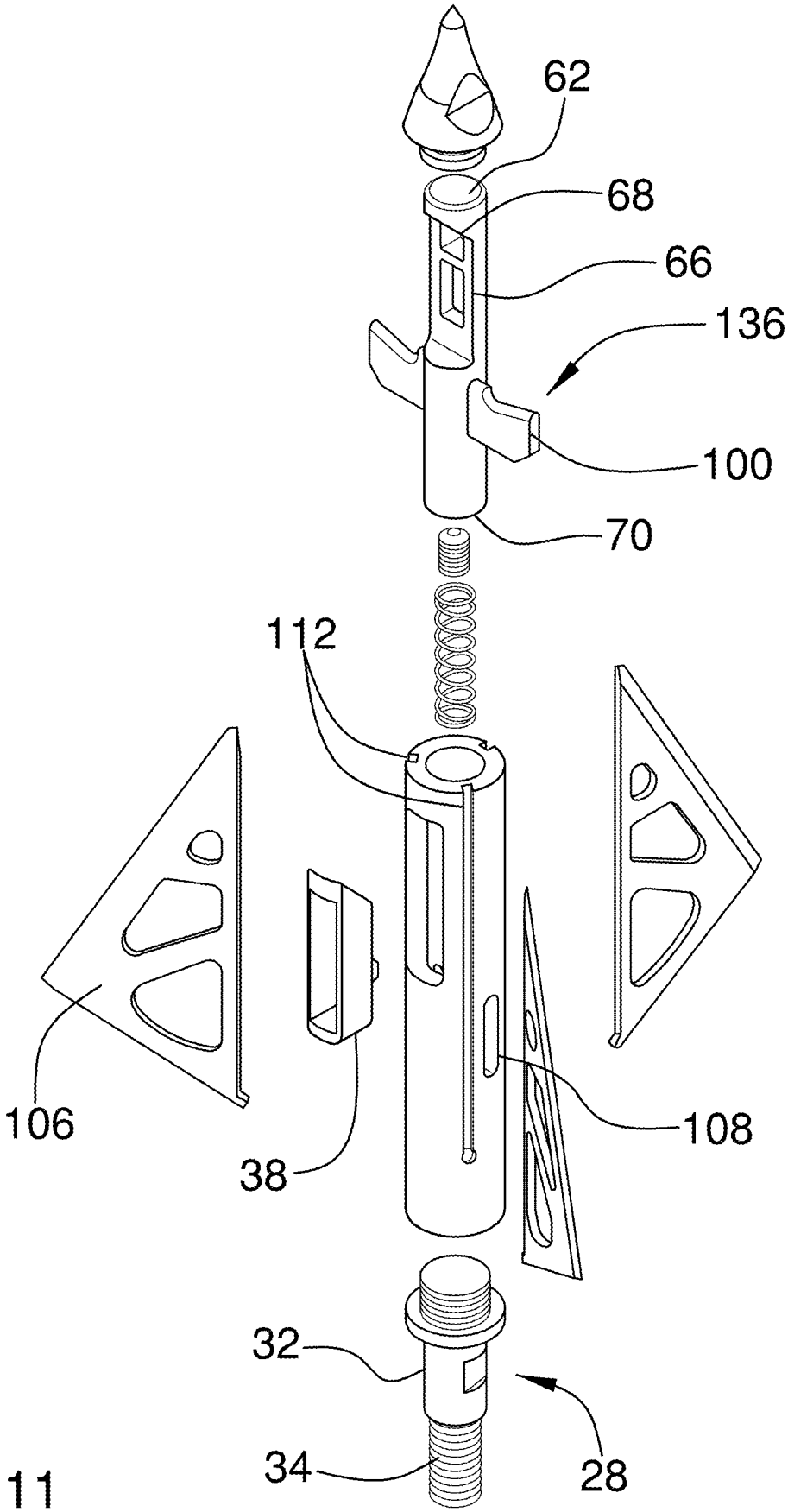
FIG. 11 is an exploded view of an embodiment of the disclosure.

An arrow shaft coupler 28 may be coupled to and extend downwardly from the aft end 14 of the arrowhead 12. The arrow shaft coupler 28 removably couples the arrowhead 12 to an arrow shaft 30. The arrow shaft coupler 28 may have a diameter that is less than a diameter of the ferrule 18 of the arrowhead 12. The arrow shaft coupler 28 may be removably couplable to the arrowhead 12, as shown in FIG. 11. In other embodiments, the arrow shaft coupler 28 may be integrally formed with the arrowhead 12, for example as shown in FIG. 10.

The arrow shaft coupler 28 may include an arrow shaft coupler primary rod 32 that is centered on the aft end 14 of the ferrule 18. An arrow shaft coupler secondary rod 34 may be coupled to and extend downwardly from the arrow shaft coupler primary rod 32. The arrow shaft coupler secondary rod 34 is generally centered on the arrow shaft coupler primary rod 32. The arrow shaft coupler secondary rod 34 may have a diameter that is less than a diameter of the arrow shaft coupler primary rod 32. The arrow shaft coupler secondary rod 34 may be threaded wherein the arrow shaft coupler secondary rod 34 is threadably couplable to the arrow shaft 30.

A tracker 36 is releasably coupled to the arrowhead 12. The tracker 36 is configured to be released from the arrowhead 12 when the arrowhead 12 moves through a body of an animal, such as a deer, that a user is hunting. As explained in more detail below, the tracker 36 may be released from the arrowhead 12 and may be configured to become securely positioned, or embedded, within the animal wherein the tracker 36 is configured to facilitate the user in locating the animal after the animal has been shot by the arrowhead 12. Thus, even if the arrowhead 12 passes completely through the animal, the tracker 36 will remain within the body of the animal.

Figure 16:
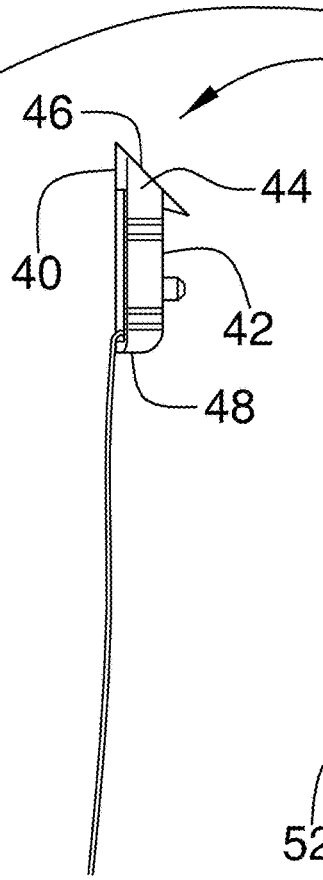
FIG. 16 is a side view of an embodiment of the disclosure.
Figure 17:
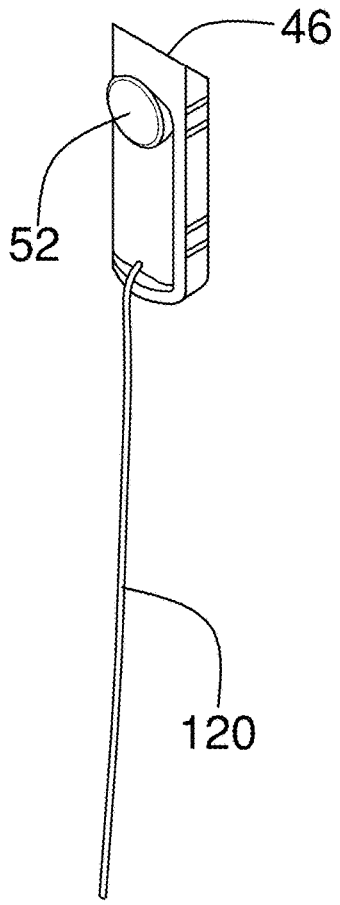
FIG. 17 is an isometric view of an embodiment of the disclosure.
Figure 18:
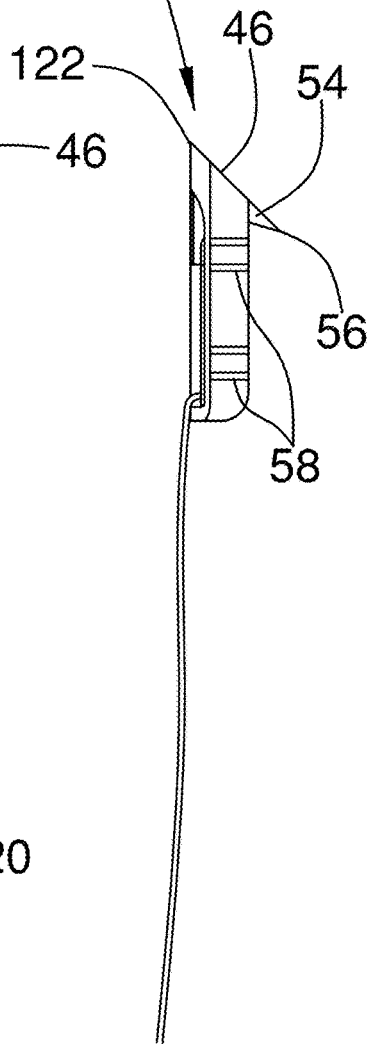
FIG. 18 is a side view of an embodiment of the disclosure.

The tracker 36 may include a tracker housing 38 that has a front side 40, a back side 42, and a pair of lateral sides 44 that are each coupled to and extend between the front side 40 and the back side 42. The tracker housing 38 also generally has an upper end 46 and a lower end 48. The upper end 46 is generally angled to extend outwardly from the front side 40 and downwardly toward the back side 42 wherein the front side 40 has a height exceeding a height of the back side 42. The lower end 48 may have rounded corners to facilitate removal of the tracker housing 38 from the arrowhead 12. Additionally, as shown in FIGS. 16 and 18, a junction between the back side 42 and the lower end 48 of the housing may be curved or rounded to facilitate removal of the tracker housing 38 from the arrowhead 12.

The tracker housing 38 may further include a sharpened upper edge 122, for example positioned at a junction between the front side 40 and the upper end 46. The sharpened upper edge 122 is sharpened wherein the sharpened upper edge 122 is configured to penetrate the body of the animal to facilitate the tracker housing 38 in becoming embedded within the body of the animal once the tracker 36 is released from the arrowhead 12.

The tracker housing 38 may be positionable within the tracker slot 26 extending into the ferrule 18. The front side 40 of the tracker housing 38 is generally coplanar with the outer surface 50 of the ferrule 18 of the arrowhead 12 when the tracker 36 is coupled to the arrowhead 12. In other words, the tracker housing 38 may be removably positioned within the tracker slot 26 extending into the ferrule 18, such that the tracker 36 does not extend outwardly from the ferrule 18. In such embodiments, the tracker housing 38 is inhibited from changing the flight trajectory of the arrowhead 12 or the arrow shaft 30.

A transmitter 52 is coupled to the tracker housing 38. The transmitter 52 is generally positioned on the front side 40 of the tracker housing 38. For example, the transmitter 52 may be coplanar with the outer surface 50 of the ferrule 18 of the arrowhead 12 when the tracker 36 is coupled to the arrowhead 12. The transmitter 52 may be configured to wirelessly communicate with a global positioning system unit wherein the transmitter 52 is configured to identify a geographic location of the tracker housing 38. In such embodiments, the transmitter 52 may comprise a global positioning system transmitter. Alternatively, the transmitter 52 may be configured to wirelessly communicate with a radio frequency receiver unit using radio frequency signals to identify the geographic location of the tracker housing 38. The transmitter 52 may also comprise a transponder or a transceiver, which can both send and receive signals.

A projection 54 may be coupled to the tracker housing 38. The projection 54 generally extends outwardly from the back side 42 of the tracker housing 38. The projection 54 may be integrally formed with the tracker housing 38 to inhibit the projection 54 from being decoupled from the tracker housing 38. The projection 54 is generally tapered to a point 56 wherein the projection 54 is configured to penetrate the body of the animal. The projection 54 secures the tracker housing 38 within the body of the animal when the tracker 36 is released from the arrowhead 12 whereby the tracker 36 is configured to facilitate locating the animal using the geographic location of the tracker housing 38.

A tracker housing retainer 58 may be coupled to the tracker housing 38. For example, the tracker housing retainer 58 may extend outwardly from each lateral side of the pair of lateral sides 44 of the tracker housing 38. In such embodiments, the tracker housing retainer 58 physically contacts opposing sides of the tracker slot 26 to form an interference fit between the tracker housing 38 and the ferrule 18 of the arrowhead 12.

An antenna 120 may be coupled to the tracker housing 38. The antenna 120 is electrically coupled to the transmitter 52. The antenna 120 generally extends outwardly from the transmitter 52, and from the tracker housing 38. The antenna 120 may be elongated wherein the antenna 120 is configured to extend outwardly from the body of the animal while the tracker housing 38 is positioned within the body of the animal. The antenna 120 is configured to facilitate the transmitter 52 in wirelessly communicating with either the global positioning system unit or the radio frequency receiver unit while the transmitter 52 is embedded within the body of the animal. As shown in FIGS. 15-18, the antenna 120 may comprise a whip antenna.

An ejector 60 is movably positioned within the arrowhead interior space 20 of the arrowhead 12. The ejector 60 is operably coupled to the tracker 36 wherein movement of the ejector 60 within the arrowhead interior space 20 releases the tracker 36 from the arrowhead 12. The ejector 60 may have a size that is complementary to a size of the tip end opening 22 wherein the ejector 60 is positionable within the arrowhead interior space 20 through the tip end opening 22.

The ejector 60 may have an ejector top end 62 that is generally positioned proximate to the tip end opening 22 of the arrowhead 12. For example, the ejector top end 62 may be positioned proximate to a bottom surface 64 of the arrow tip 24 within the arrowhead interior space 20 before the arrowhead 12 impacts the animal.

A cutout 66 is positioned proximate to the ejector top end 62. The cutout 66 is alignable with the tracker slot 26 of the arrowhead 12. The cutout 66 generally has a shape that is complementary to a shape of the tracker housing 38 wherein the tracker housing 38 is positionable within the cutout 66 through the tracker slot 26.

The cutout 66 has a sloped upper wall 68 that is angled to complement the angle of the upper end 46 of the tracker housing 38. The sloped upper wall 68 may be in contact with the upper end 46 of the tracker housing 38 before the tracker 36 is released from the arrowhead 12, or, in other words, while the ejector 60 is in a pre-impact position. For example, the upper end 46 of the tracker housing 38 may be positioned flush against the sloped upper wall 68 while the tracker housing 38 is positioned within the cutout 66 through the tracker slot 26. When the arrowhead 12 moves through the animal, the ejector 60 moves backwardly away from the tip end 16 of the arrowhead 12, and the sloped upper wall 68 is designed to slide downwardly along the upper end 46 of the tracker housing 38. The angles of the sloped upper wall 68 of the cutout 66 and the upper end 46 of the tracker housing 38 urge the tracker housing 38 outwardly from the arrowhead 12 when the arrowhead 12 impacts the animal.

An ejector base end 70 is spaced from the aft end 14 of the arrowhead 12. The ejector 60 is configured to be movable away from the tip end 16 of the arrowhead 12 when the arrowhead 12 impacts and moves through the animal. The ejector base end 70 is configured to move downwardly toward the aft end 14 of the arrowhead 12 to release the tracker 36. In other words, the arrowhead interior space 20 may have a height exceeding a height of the ejector 60, wherein the ejector 60 can move vertically within the arrowhead interior space 20, from the tip end 16 toward the aft end 14 of the arrowhead 12.

An acceleration force retainer 72 may be positioned proximate to the aft end 14 of the arrowhead 12. The acceleration force retainer 72 is generally positioned between the tracker 36 and the aft end 14 of the arrowhead 12 wherein the acceleration force retainer 72 is configured to secure the ejector 60 in the pre-impact position within the arrowhead interior space 20 while the arrowhead 12 flies toward the animal. The acceleration force retainer 72 is operably coupled to the ejector 60 wherein the acceleration force retainer 72 is configured to release the ejector 60 once the arrowhead 12 impacts the animal to facilitate movement of the ejector 60 downwardly toward the aft end 14 of the arrowhead 12.

As shown in FIGS. 1-4, the acceleration force retainer 72 may include a spring finger ledge 80 that is coupled to and extends outwardly from an inner surface of the ferrule 18 into the arrowhead interior space 20. In such embodiments, the acceleration force retainer 72 may also include a plurality of spring fingers 74. Each spring finger of the plurality of spring fingers 74 generally includes a spring finger plate 76 that is pivotably coupled to and extends downwardly from the ejector base end 70. A spring finger lip 78 may be coupled to the spring finger plate 76 distally to the ejector base end 70. The spring finger lip 78 extends outwardly from the spring finger plate 76. The spring finger lip 78 is positionable on the spring finger ledge 80 to retain the position of the ejector 60 within the arrowhead interior space 20 while the arrowhead 12 accelerates and flies toward the animal. The spring finger plate 76 is configured to pivot inwardly so that the spring finger lip 78 can slide downwardly past the spring finger ledge 80 when the arrowhead 12 impacts the animal.

As shown in FIGS. 6-10, the acceleration force retainer 72 may comprise a shear pin 82. In such embodiments, a ferrule shear pin aperture 86 may extend through the outer surface 50 of the ferrule 18 into the arrowhead interior space 20. An ejector shear pin aperture 88 may extend into the ejector 60. The ferrule shear pin aperture 86 is alignable with the ejector shear pin aperture 88 when the ejector top end 62 is positioned proximate to the tip end 16 of the arrowhead 12. In other words, the ferrule shear pin aperture 86 is alignable with the ejector shear pin aperture 88 while the ejector 60 is in the pre-impact position. The shear pin 82 is positionable to extend through the ferrule shear pin aperture 86 into the ejector shear pin aperture 88. When the arrowhead 12 impacts the animal, the shear pin 82 is configured to break, releasing the ejector 60 such that the ejector 60 can move downwardly toward the aft end 14.

Such embodiments may further include a shear pin spring 84 that is coupled to the ejector base end 70. The shear pin spring 84 is biased to expand. When the ejector 60 moves downwardly toward the aft end 14 of the arrowhead 12 to release the tracker 36, the ejector 60 may compress the shear pin spring 84. After the arrowhead 12 has passed completely through the body of the animal, and the tracker 36 has been released, the shear pin spring 84 may expand to urge the ejector 60 upwardly and return the ejector 60 to the pre-impact position.

Figure 13:
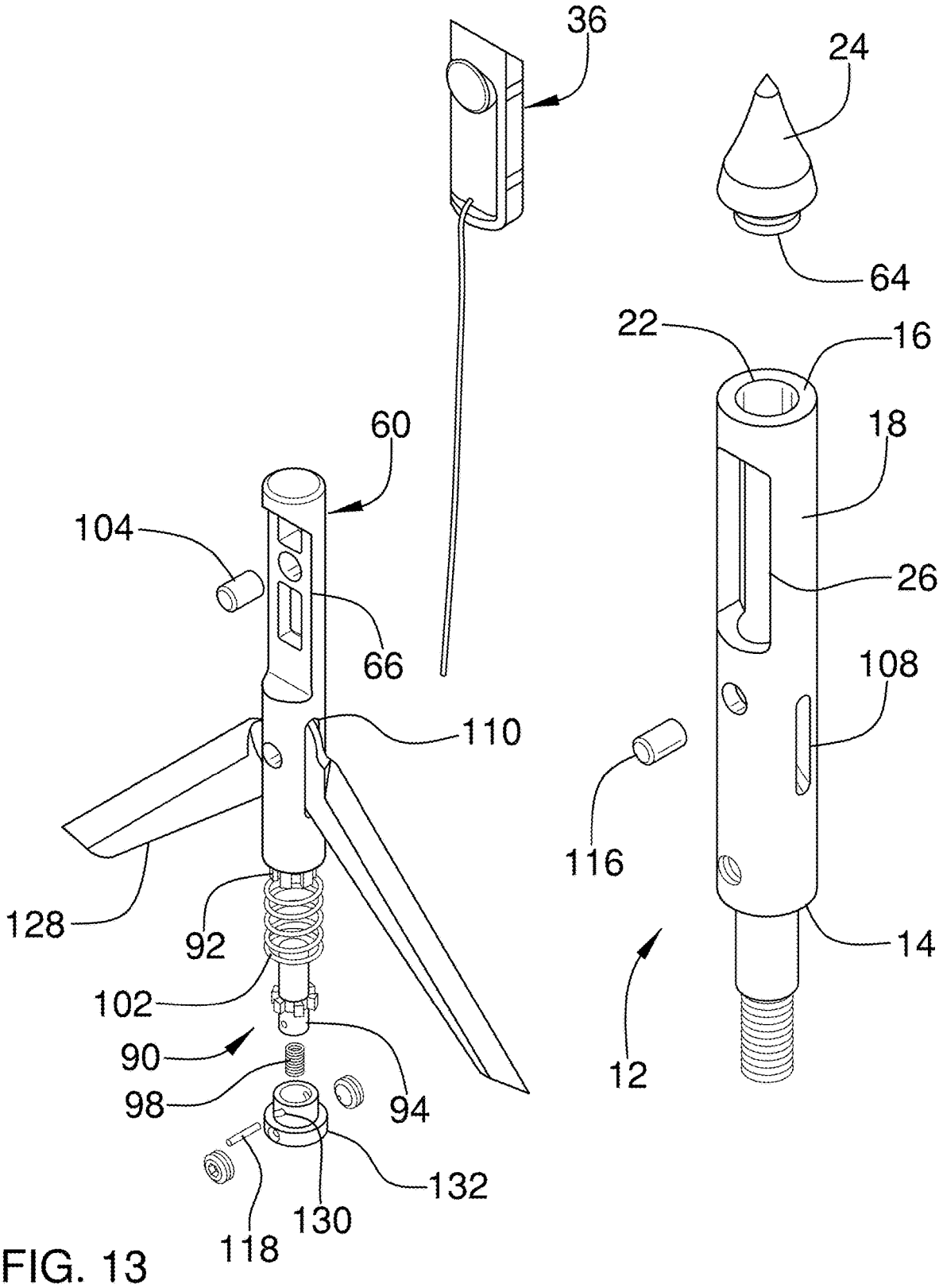
FIG. 13 is an exploded view of an embodiment of the disclosure.
Figure 14A:
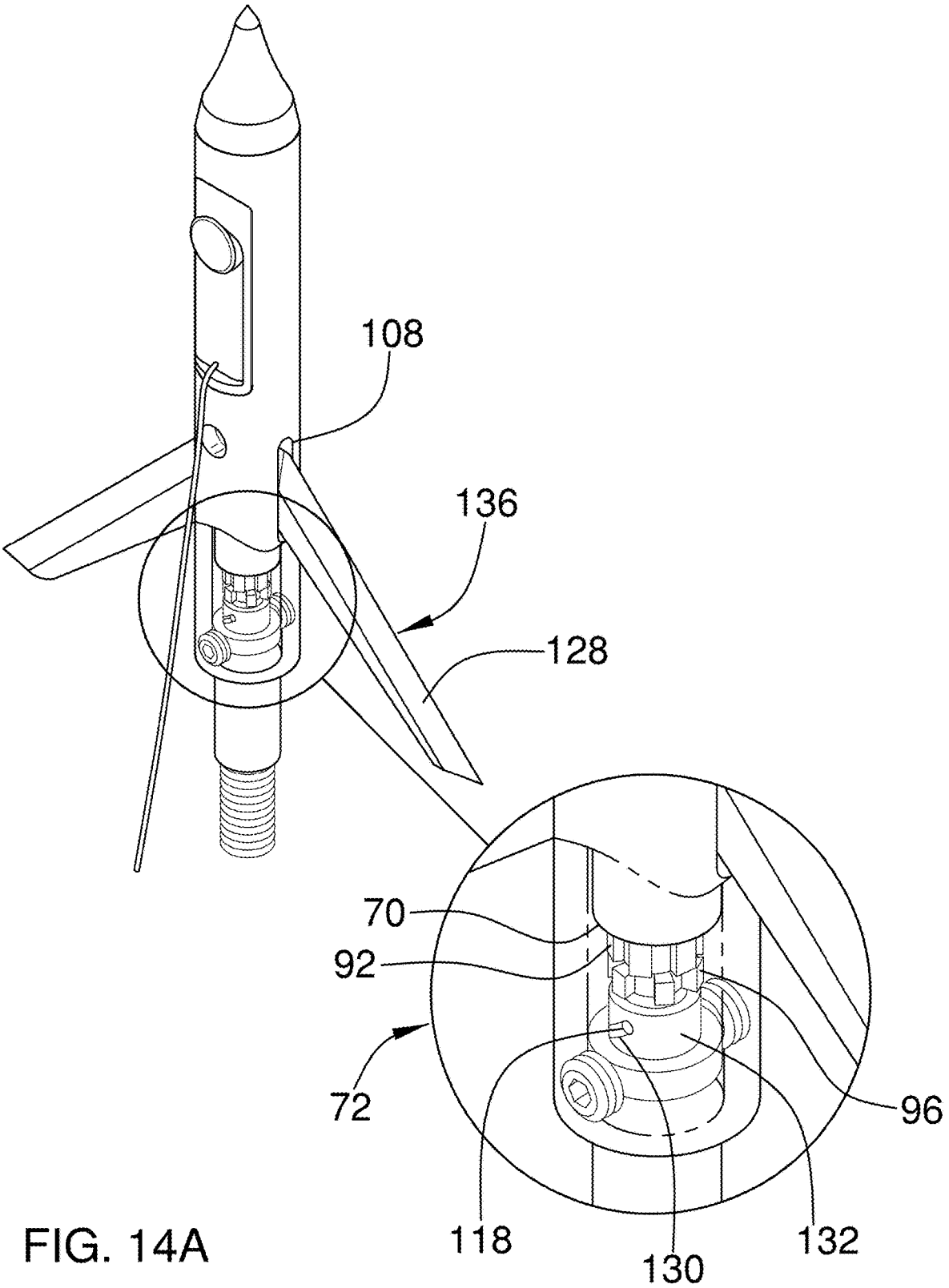
FIG. 14A is an isometric view of an embodiment of the disclosure.
Figure 14B:
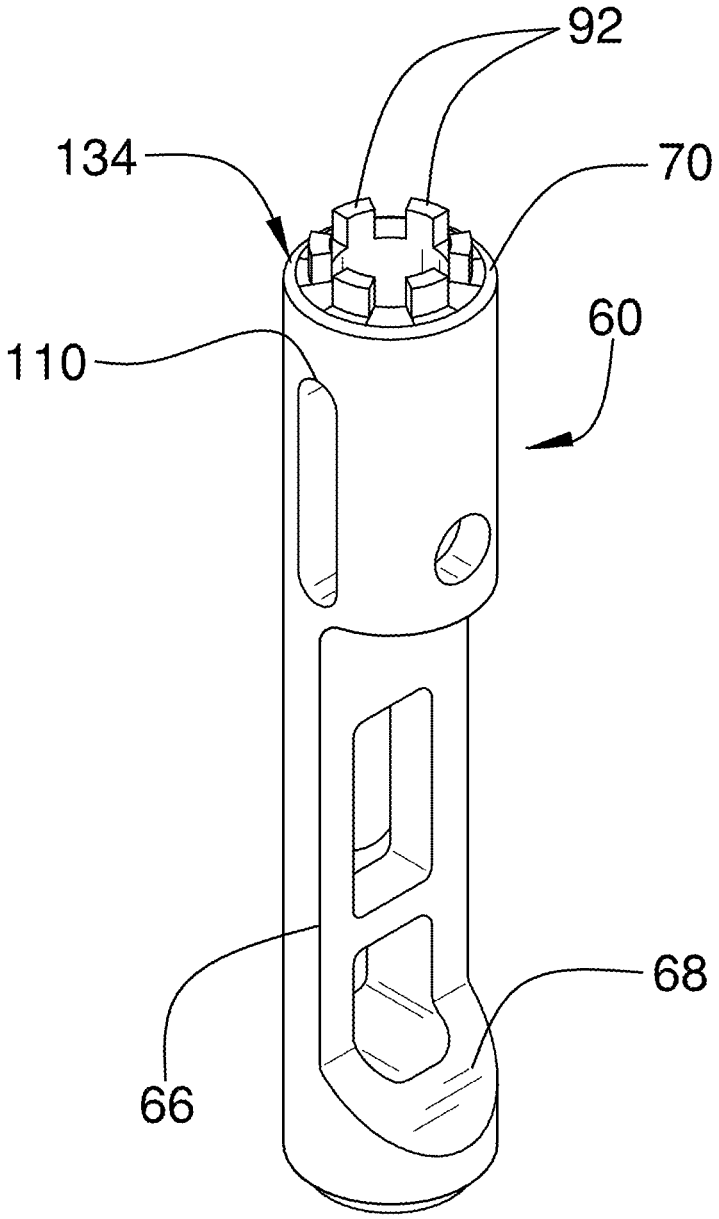
FIG. 14B is a perspective view of an embodiment of the disclosure.
Figure 15:
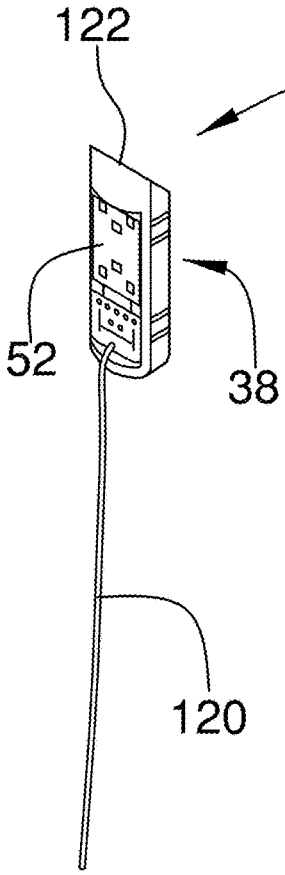
FIG. 15 is an isometric view of an embodiment of the disclosure.

As shown in FIGS. 13, 14A, and 14B, the acceleration force retainer 72 may comprise a rotating indexer mechanism 90. The rotating indexer mechanism 90 generally includes a plurality of indexer guide fingers 92 that are each coupled to and extend downwardly from the ejector base end 70. The plurality of indexer guide fingers 92 may be spaced from each other around a circumferential edge of the ejector base end 70. Alternatively, the plurality of indexer guide fingers 92 may be centrally positioned on the ejector base end 70, such that the plurality of indexer guide fingers 92 are spaced from the circumferential edge of the ejector base end 70. FIG. 14B provides an example of such embodiments. As shown, an ejector pocket 134 may extend into the ejector base end 70 and circumscribe the plurality of indexer guide fingers 92.

In such embodiments, an indexer base 94 is rotatably coupled to the aft end 14 of the ferrule 18 of the arrowhead 12. The indexer base 94 is positioned within the arrowhead interior space 20. The indexer base 94 generally includes a plurality of indexer base fingers 96 that are configured to be aligned with and in physical contact with the plurality of indexer guide fingers 92 while the arrowhead 12 is launched and flies toward the animal. The physical contact between the plurality of indexer guide fingers 92 and the plurality of indexer base fingers 96 secures the ejector 60 in the pre-impact position during the acceleration and flight of the arrow. The ejector 60 is thus inhibited from moving backwardly, or downwardly, toward the aft end 14 of the arrowhead 12 while the arrowhead 12 flies toward the animal.

In such embodiments, an indexer pin 118 may be operably coupled to the indexer base 94. The indexer pin 118 is configured to rotate the indexer base 94 in a first direction when the arrowhead 12 is launched toward the animal. Rotation of the indexer base 94 in the first direction aligns the plurality of indexer base fingers 96 with the plurality of indexer guide fingers 92. The indexer pin 118 is configured to subsequently rotate the indexer base 94 in a second direction. Rotation of the indexer base 94 in the second direction positions each indexer guide finger of the plurality of indexer guide fingers 92 between adjacent pairs of the plurality of indexer base fingers 96 to allow downward, or backward, movement of the ejector 60 toward the aft end 14 of the arrowhead 12.

As shown in FIG. 13, the indexer pin 118 may be movably positioned within an indexer base channel 130 extending into an indexer base receiver 132. The indexer base 94 is positionable within the indexer base receiver 132, such that the indexer pin 118 extends through the indexer base channel 130 into the indexer base 94. An indexer first spring 98 may be coupled to the indexer base 94. The indexer first spring 98 may also be operably coupled to the indexer pin 118. While the arrowhead 12 is flying, momentum may pull the indexer base 94 backwardly toward the aft end 14, and the indexer base 94 may compress the indexer first spring 98. The indexer pin 118 may slide, or move, in a primary direction within the indexer base channel 130 to rotate the indexer base 94 in the first direction. Upon impact with the animal, the indexer first spring 98 may expand to urge the indexer pin 118 in a secondary direction through the indexer base channel 130, rotating the indexer base 94 in the second direction. The secondary direction may be the opposite, or reverse, of the primary direction. For example, the indexer first spring 98 is generally biased to expand. The indexer first spring 98 may therefore expand after being compressed by the indexer base 94, moving the indexer pin 118 in the secondary direction through the indexer base channel 130.

Once the plurality of indexer guide fingers 92 are offset from the plurality of indexer base fingers 96, the ejector 60 can move backwardly, or downwardly, toward the aft end 14. The ejector 60 may be coupled to an indexer second spring 102. Movement of the ejector 60 toward the aft end 14 may compress the indexer second spring 102. After the arrowhead 12 has passed through, or been removed from, the animal, the indexer second spring 102 may urge the ejector 60 upward to the pre-impact position. In some embodiments, the indexer second spring 102 may be positioned within the indexer pocket 134 while the indexer second spring 102 is compressed.

An actuator 136 extends outwardly from the ferrule 18 of the arrowhead 12. The actuator 136 is configured to contact the body of the animal when the arrowhead 12 moves through the animal. The actuator 136 is generally movably coupled to the ferrule 18 of the arrowhead 12 wherein the actuator 136 is configured to move backwardly toward the aft end 14 of the arrowhead 12 when the actuator 136 contacts the body of the animal. The actuator 136 is coupled to the ejector 60 wherein the actuator 136 urges the ejector 60 backwardly toward the aft end 14 of the arrowhead 12 when the actuator 136 moves toward the aft end 14.

The actuator 136 is generally positioned proximate to the aft end 14 of the arrowhead 12, wherein the tracker 36 is positioned between the tip end 16 and the actuator 136. Accordingly, the actuator 136 will not move backwardly to urge the ejector 60 toward the aft end 14 of the arrowhead 12 until enough of the arrowhead 12 has moved through the animal to position the tracker housing 38 within the body of the animal. This relative positioning helps to ensure that the tracker 36 becomes secured or embedded within the body of the animal once the tracker 36 is released from the arrowhead 12 and inhibits the tracker 36 from merely falling to the ground near the site of the impact.

As shown in FIGS. 1-10 and 13-15, the actuator 136 may comprise a pair of actuator blades 128. The pair of actuator blades 128 are generally coupled to the ejector 60 and extend outwardly from the arrowhead 12 through the pair of ferrule actuator slots 108. The pair of ferrule actuator slots 108 generally have a height exceeding a height of the pair of actuator blades 128 wherein the pair of actuator blades are movable between the ferrule actuator slot top end 124 and the ferrule actuator slot bottom end 126.

When the ejector 60 is in the pre-impact position, the pair of actuator blades 128 are generally positioned against the ferrule actuator slot top end 124. Contact between the pair of actuator blades 128 and the ferrule actuator slot top end 124 of each ferrule actuator slot of the pair of ferrule actuator slots 108 inhibits the ejector 60 from moving forwardly toward the tip end 16 of the arrowhead 12 while the arrowhead 12 flies toward the animal.

When the arrowhead 12 impacts and moves through the animal, the pair of actuator blades 128 may catch on the flesh of the body of the animal, causing the pair of actuator blades 128 to move, or slide, backwardly to the ferrule actuator slot bottom end 126. This backward, or downward, movement of the pair of actuator blades 128 through the pair of ferrule actuator slots 108 urges the ejector 60 toward the aft end 14 of the arrowhead 12.

Each actuator blade of the pair of actuator blades 128 may have a leading edge 114 that faces upwardly toward the tip end 16 of the arrowhead 12. The leading edge 114 is generally the first edge to contact the animal upon impact of the arrowhead 12. The leading edge 114 of each blade of the pair of actuator blades 128 may be angled to extend outwardly from the ferrule 18 and downwardly toward the aft end 14 of the arrowhead 12. The leading edge 114 may be sharpened wherein the leading edge 114 is configured to facilitate the pair of actuator blades 128 in penetrating the body of the animal so that the arrowhead 12 can move through the animal.

Figure 19:
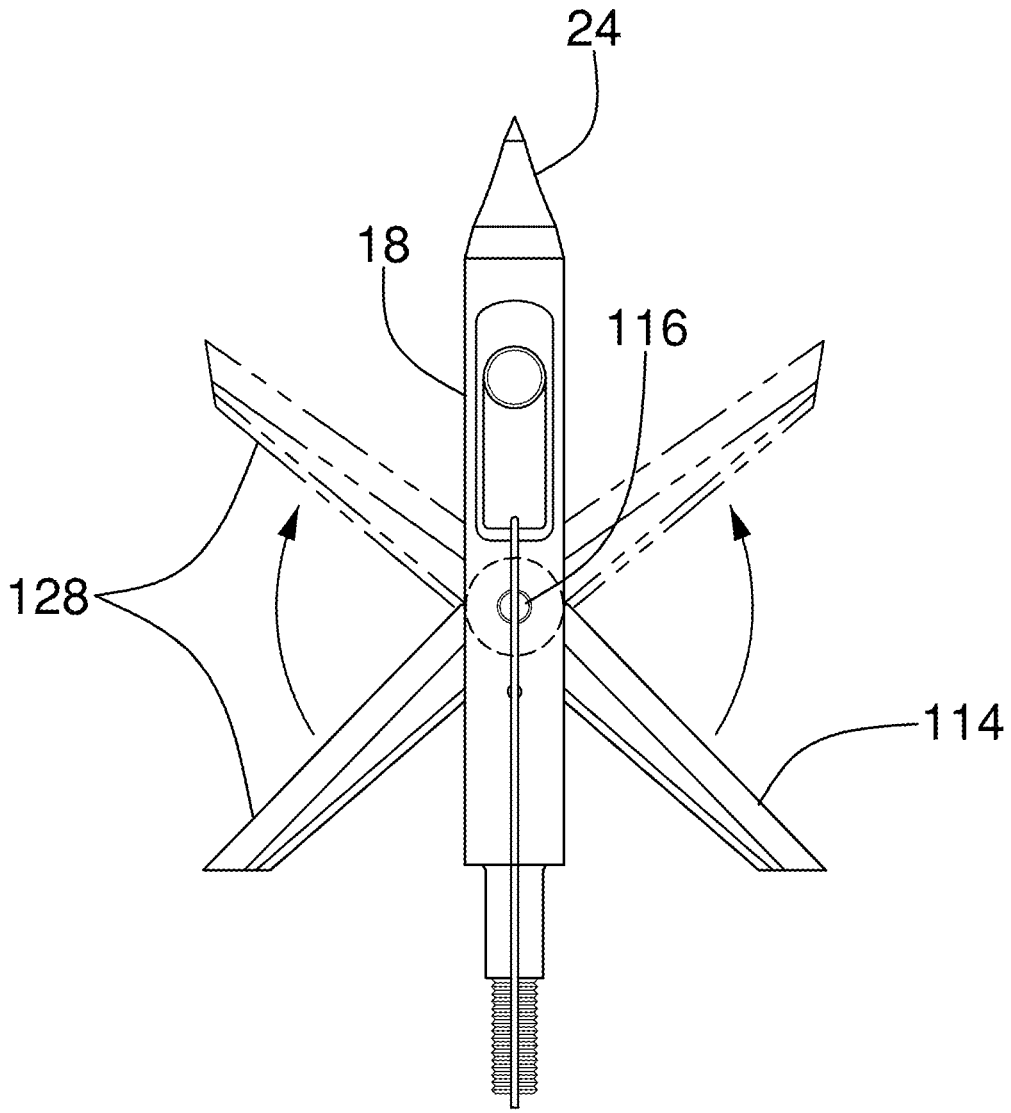
FIG. 19 is a front view of an embodiment of the disclosure.
Figure 20:
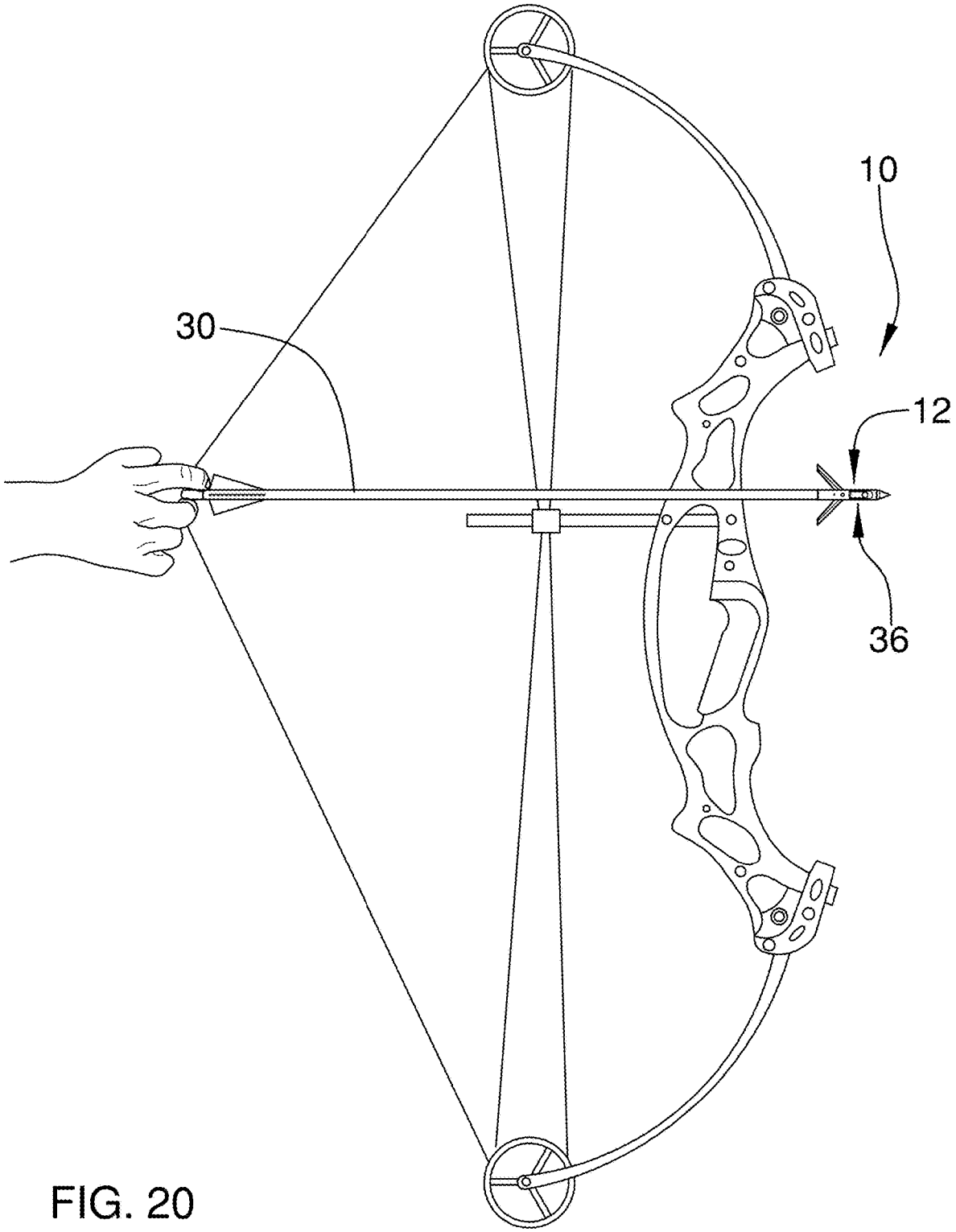
FIG. 20 is an in-use view of an embodiment of the disclosure.

An ejector blade slot 110 may extend through the ejector 60. The ejector blade slot 110 is generally alignable with the pair of ferrule actuator slots 108. The pair of actuator blades 128 may be pivotably coupled to the ejector 60 within the ejector blade slot 110. For example, a fastener 116, such as a dowel pin, may extend through the ferrule 18 and the ejector 60 and into the pair of actuator blades 128, such that the pair of actuator blades 128 are coupled to and pivotable around the fastener 116. If the arrowhead 12 becomes lodged or stuck within the body of the animal, the pair of actuator blades 128 may pivot upwardly and forwardly, toward the tip end 16 of the arrowhead 12, to facilitate removal of the arrowhead 12 from the body of the animal. FIG. 19 provides an exemplary depiction of the pivotable movement of the pair of actuator blades 128.

Figure 12:
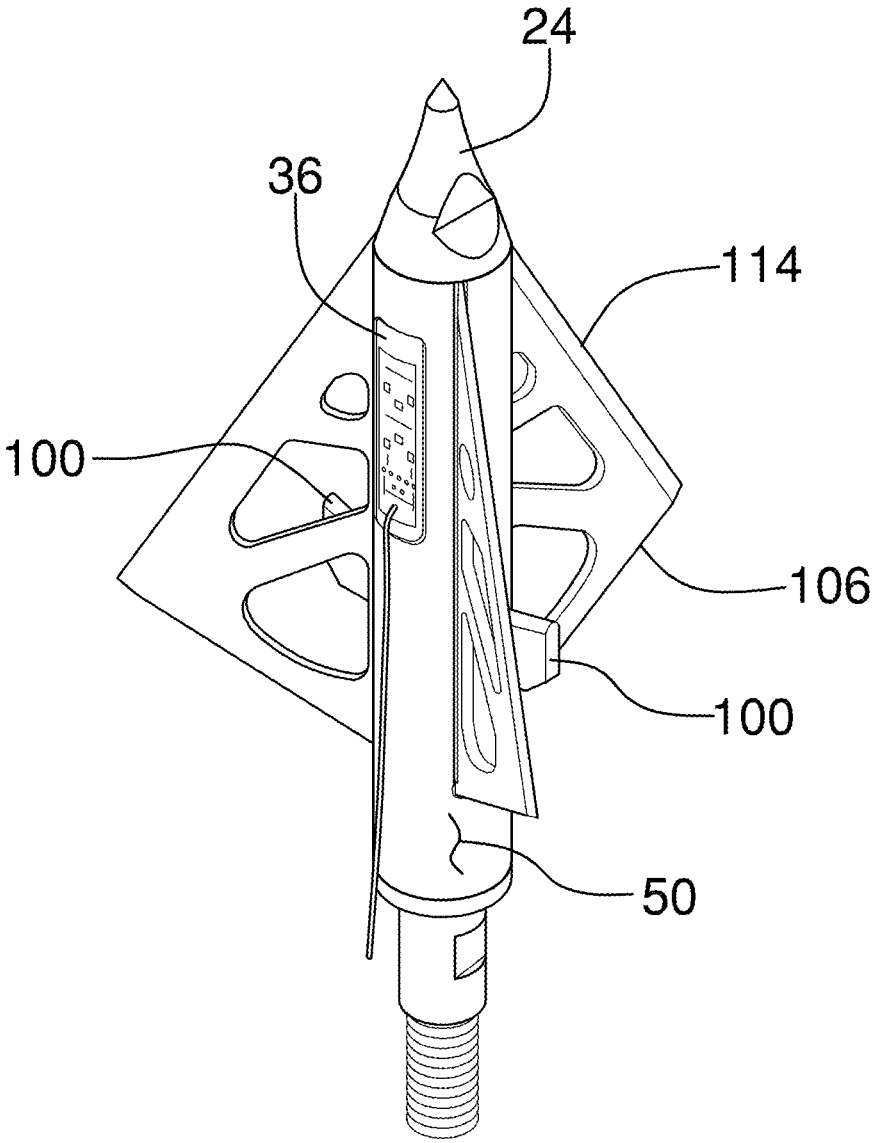
FIG. 12 is an isometric view of an embodiment of the disclosure.

As shown in FIGS. 11 and 12, the actuator 72 may alternatively comprise a pair of fins 100 that are coupled to and extend outwardly from the ejector 60. The pair of fins 100 are generally positioned on opposing sides of the ejector 60 and are generally aligned with each other across the ejector 60. The pair of fins 100 may extend outwardly from the arrowhead interior space 20 through the pair of ferrule actuator slots 108. The pair of ferrule actuator slots 108 generally have a height exceeding a height of the pair of fins 100 wherein the pair of fins 100 are movable downwardly from the ferrule actuator slot top end 124 to the ferrule actuator slot bottom end 126 when the arrowhead 12 moves through the animal. The pair of fins 100 catch on the flesh of the animal to urge the ejector 60 downwardly toward the aft end 14 of the arrowhead 12 as the pair of fins 100 slide toward the ferrule actuator slot bottom end 126.

When the ejector 60 is in the pre-impact position, the pair of fins 100 are generally positioned against the ferrule actuator slot top end 124. The contact between the pair of fins 100 and the ferrule actuator slot top end 124 of each ferrule actuator slot of the pair of ferrule actuator slots 108 inhibits the ejector 60 from moving forwardly toward the tip end 16 of the arrowhead 12 while the arrowhead 12 flies toward the animal.

In such embodiments, a plurality of static blades 106 may be coupled to the arrowhead 12. Some embodiments may include a plurality of static blade grooves 112 that extend into the outer surface 50 of the ferrule 18. In such embodiments, each static blade 106 of the plurality of static blades 106 may be positionable within a selectable respective static blade groove 112 of the plurality of static blade grooves 112 to removably couple the plurality of static blades 106 to the ferrule 18 of the arrowhead 12.

For example, the plurality of static blades 106 may include two, three, or four blades. The plurality of static blades 106 are generally spaced equidistantly from each other around the ferrule 18 to facilitate balanced flight of the arrowhead 12 through the air. The plurality of static blades 106 typically have a uniform shape and weight, again to facilitate balance during flight of the arrow shaft 30 when the arrowhead 12 is coupled to the arrow shaft 30.

The plurality of static blades 106 are each generally sharpened wherein the plurality of static blades 106 are configured to facilitate the arrowhead 12 in penetrating the body of the animal upon impact. For example, at least the leading edge 114 of each static blade of the plurality of static blades 106 is sharpened. Other edges of each static blade of the plurality of static blades 106 may also be sharpened. As with the pair of actuator blades 128, the leading edge 114 of each static blade of the plurality of static blades 106 is generally the edge facing upwardly toward the arrow tip 24, which will be the first edge to contact the animal upon impact of the arrowhead 12. The leading edge 114 of each static blade of the plurality of static blades 106 may be angled to extend outwardly from the ferrule 18 and downwardly toward the aft end 14 of the arrowhead 12.

A switch 104 may be coupled to the ejector 60. The switch 104 is generally aligned with the transmitter 52 of the tracker 36 when the tracker 36 is coupled to the arrowhead 12. The switch 104 is in communication with the transmitter 52. The switch 104 turns the transmitter 52 off when the tracker housing 38 is coupled to the arrowhead 12. While turned off, the transmitter 52 is configured to be inhibited from wirelessly communicating with the one of the global positioning system unit and the radio frequency receiver unit. The switch 104 turns the transmitter 52 on once the tracker housing 38 is released from the arrowhead 12, enabling wireless communication between the transmitter 52 and the one of the global positioning system unit and the radio frequency receiver unit.

For example, when the transmitter 52 wirelessly communicates with the radio frequency receiver unit, the switch 104 may comprise a magnet. The magnet is magnetically attracted to an electromagnetic material of the transmitter 52. When the magnet is in contact with the transmitter 52, the magnet inhibits the transmitter 52 from sending signals to the radio frequency receiver unit, thereby turning the transmitter 52 off. Once the tracker housing 38 is released from the arrowhead 12, the magnet will be spaced from the transmitter 52 such that the transmitter 52 is able to send signals to the radio frequency receiver unit.

In use, the trackable arrow assembly 10 is designed to fly through the air with the same basic trajectory as a standard arrow. For example, the tracker 36 is aligned with the arrowhead 12 wherein the tracker 36 is inhibited from interfering with the trajectory of the arrowhead 12 as the arrowhead 12 travels through the air. The trackable arrow assembly 10 may have a total weight between 100 grain and 400 grain, which is comparable to the weight of a standard arrowhead used in hunting wild game.

Before the arrowhead 12 impacts the animal, the acceleration force retainer 72 holds the ejector 60 in the pre-impact position. In other words, the acceleration force retainer 72 may facilitate the ejector 60 in withstanding the acceleration force of the arrowhead 12 such that the ejector 60 remains stationary within the arrowhead interior space 20 until the arrowhead 12 collides with the body of the animal. Upon impact, the acceleration force retainer 72 will give way, or release the ejector 60, allowing the ejector 60 to move toward the aft end 14 of the arrowhead 12.

For example, the actuator 136 may catch the flesh of the animal as the arrowhead 12 moves through the animal. As the actuator 136 moves through the flesh of the animal, the actuator 136 will move backwardly toward the aft end 14, pulling the ejector 60 backward to release the tracker 36. Once released, the projection 54 coupled to the tracker housing 38 can catch on the body of the animal, securing the tracker 36 within the animal to facilitate the user in locating the animal using the geographic location identified by the transmitter 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A trackable broadhead assembly comprising:

an arrowhead having an aft end, a tip end, and a ferrule extending between the aft end and the tip end;

a tracker being releasably coupled to the arrowhead wherein the tracker is configured to be released from the arrowhead when the arrowhead moves through an animal, the tracker including:

a tracker housing having a front side, a back side, and an upper end, the upper end being angled to extend outwardly from the front side and downwardly toward the back side;

a transmitter being coupled to the tracker housing, the transmitter being configured to wirelessly communicate with one of a global positioning system unit and a radio frequency receiver unit wherein the transmitter is configured to identify a geographic location of the tracker housing and wherein the tracker is configured to facilitate locating the animal using the geographic location of the tracker housing;

an ejector being movably positioned within the ferrule, the ejector being operably coupled to the tracker wherein movement of the ejector within the ferrule releases the tracker from the arrowhead, the ejector including:

an ejector top end being positioned adjacent to the tip end of the arrowhead; and a cutout being positioned adjacent to the ejector top end, the cutout having a shape being complementary to a shape of the tracker housing wherein the tracker housing is positionable within the cutout, the cutout including:

a sloped upper wall being angled to complement the upper end of the tracker housing wherein the sloped upper wall is in contact with the upper end of the tracker housing and wherein the sloped upper wall is configured to slide downwardly against the upper end of the tracker housing to urge the tracker housing outwardly from the arrowhead into the animal.

2. The trackable broadhead assembly of claim 1, further comprising:

a pair of ferrule actuator slots extending through an outer surface of the ferrule into the arrowhead interior space; and an actuator extending outwardly through the pair of ferrule actuator slots wherein the actuator is configured to contact the body of the animal when the arrowhead moves through the animal, the actuator being movably coupled to the ferrule of the arrowhead wherein the actuator is configured to move backwardly toward the aft end of the arrowhead when the actuator contacts the body of the animal, the actuator being coupled to the ejector wherein the actuator urges the ejector backwardly toward the aft end of the arrowhead when the actuator moves toward the aft end of the arrowhead.

3. The trackable broadhead assembly of claim 2, the actuator further comprising a pair of actuator blades being movably positioned within the pair of ferrule actuator slots, the pair of ferrule actuator slots having a height exceeding a height of the pair of actuator blades, the pair of actuator blades being coupled to the ejector wherein the pair of actuator blades are configured to slide downwardly from a ferrule actuator slot top end to a ferrule actuator slot bottom end when the arrowhead moves through the animal to urge the ejector toward the aft end of the arrowhead.

4. The trackable broadhead assembly of claim 2, the actuator further comprising a pair of fins being coupled to and extending outwardly from the ejector, the pair of fins extending through the pair of ferrule actuator slots, the pair of ferrule actuator slots having a height exceeding a height of the pair of fins wherein the pair of fins are movable downwardly from a ferrule actuator slot top end to a ferrule actuator slot bottom end when the arrowhead moves through the animal, the pair of fins urging the ejector downwardly toward the aft end of the arrowhead when the pair of fins move toward the ferrule actuator slot bottom end.

5. The trackable broadhead assembly of claim 4, further comprising a plurality of static blades being removably couplable to the arrowhead, each static blade of the plurality of static blades being sharpened wherein the plurality of static blades are configured to facilitate the arrowhead in penetrating the body of the animal, the plurality of static blades being angled to extend outwardly from the ferrule and downwardly toward the aft end of the arrowhead.

6. The trackable broadhead assembly of claim 1, further comprising an acceleration force retainer being positioned proximate to the aft end of the arrowhead, the acceleration force retainer being positioned between the tracker and the aft end of the arrowhead wherein the acceleration force retainer is configured to secure a position of the ejector within the arrowhead interior space while the arrowhead flies toward the animal, the acceleration force retainer being operably coupled to the ejector wherein the acceleration force retainer is configured to release the ejector once the arrowhead impacts the animal to facilitate movement of the ejector toward the aft end of the arrowhead.

7. The trackable broadhead assembly of claim 6, the acceleration force retainer further comprising:

a spring finger ledge extending outwardly from an inner surface of the ferrule into an arrowhead interior space of the arrowhead; and a plurality of spring fingers, each spring finger of the plurality of spring fingers including:

a spring finger plate being pivotably coupled to and extending downwardly from the ejector; and a spring finger lip being coupled to the spring finger plate, the spring finger lip extending outwardly from the spring finger plate wherein the spring finger lip is positionable on to rest on the spring finger ledge, the spring finger plate being configured to pivot inwardly to slide the spring finger lip downwardly past the spring finger ledge when the arrowhead impacts the animal.

8. The trackable broadhead assembly of claim 6, the acceleration force retainer further comprising:

a ferrule shear pin aperture extending through an outer surface of the ferrule into an arrowhead interior space of the arrowhead;

an ejector shear pin aperture extending into the ejector; and a shear pin being positionable to extend through the ferrule shear pin aperture into the ejector shear pin aperture, the shear pin being configured to secure a position of the ejector before the arrowhead impacts the animal, the shear pin being configured to break when the arrowhead impacts the animal.

9. The trackable broadhead assembly of claim 6, the acceleration force retainer further comprising a rotating indexer mechanism including:

a plurality of indexer guide fingers being coupled to and extending downwardly from the ejector;

an indexer base being rotatably coupled to the aft end of the ferrule of the arrowhead, the indexer base including a plurality of indexer base fingers being configured to be aligned with and in physical contact with the plurality of indexer guide fingers to secure a position of the ejector within the arrowhead while the arrowhead flies toward the animal; and an indexer pin being operably coupled to the indexer base wherein the indexer pin is configured to rotate the indexer base in a first direction when the arrowhead is launched toward the animal to align the plurality of indexer base fingers with the plurality of indexer guide fingers while the arrowhead flies toward the animal, the indexer pin being configured to rotate the indexer base in a second direction to position each indexer guide finger of the plurality of indexer guide fingers between respective adjacent pairs of the plurality of indexer base fingers to allow downward movement of the ejector toward the aft end of the ferrule.

10. The trackable broadhead assembly of claim 1, the tracker further comprising a projection extending outwardly from the back side of the tracker housing, the projection being integrally formed with the tracker housing, the projection being tapered to a point wherein the projection is configured to penetrate a body of the animal to secure the tracker housing within the body of the animal when the tracker is released from the arrowhead upon impact with the animal whereby the tracker is configured to facilitate locating the animal using the geographic location of the tracker housing.

11. The trackable broadhead assembly of claim 1, the tracker further comprising a tracker housing retainer being coupled to the tracker housing, the tracker housing retainer extending outwardly from each lateral side of a pair of lateral sides of the tracker housing wherein the retainer physically contacts opposing sides of a tracker slot extending through the ferrule to form an interference fit between the tracker housing and the ferrule of the arrowhead.

12. A trackable broadhead assembly comprising:

an arrowhead having an aft end, a tip end, and a ferrule extending between the aft end and the tip end to define an arrowhead interior space, the tip end being removably couplable to an arrow tip, the ferrule being cylindrical, the arrowhead further including:

a tip end opening extending through the tip end into the arrowhead interior space, the tip end opening having a size being complementary to a size of the arrow tip wherein the tip end opening is configured to receive the arrow tip and wherein the arrow tip is positionable within the tip end opening to selectively cover the tip end opening;

a tracker slot extending through an outer surface of the ferrule into the arrowhead interior space, the tracker slot being positioned proximate to the tip end;

a pair of ferrule actuator slots extending through the outer surface of the ferrule into the arrowhead interior space, each ferrule actuator slot of the pair of ferrule actuator slots having a ferrule actuator slot top end and a ferrule actuator slot bottom end;

an arrow shaft coupler being coupled to and extending downwardly from the aft end of the arrowhead wherein the arrow shaft coupler removably couples the arrowhead to an arrow shaft, the arrow shaft coupler having a diameter being less than a diameter of the ferrule of the arrowhead, the arrow shaft coupler including:

an arrow shaft coupler primary rod being centered on the aft end of the ferrule;

an arrow shaft coupler secondary rod being coupled to and extending downwardly from the arrow shaft coupler primary rod, the arrow shaft coupler secondary rod being centered on the arrow shaft coupler primary rod, the arrow shaft coupler secondary rod having a diameter being less than a diameter of the arrow shaft coupler primary rod, the arrow shaft coupler secondary rod being threaded wherein the arrow shaft coupler secondary rod is threadably couplable to the arrow shaft;

a tracker being releasably coupled to the arrowhead wherein the tracker is configured to be released from the arrowhead when the arrowhead moves through an animal, the tracker including:

a tracker housing having a front side, a back side, and a pair of lateral sides being coupled to and extending between the front side and the back side, the tracker housing having an upper end and a lower end, the upper end being angled to extend outwardly from the front side and downwardly toward the back side wherein the front side has a height exceeding a height of the back side, the tracker housing being positionable within the tracker slot wherein the front side of the tracker housing is coplanar with the outer surface of the ferrule of the arrowhead when the tracker is coupled to the arrowhead, the tracker housing further comprising:

a sharpened upper edge being positioned at a junction between the front side and the upper end, the sharpened upper edge being sharpened wherein the sharpened upper edge is configured to penetrate a body of the animal to facilitate the tracker housing in becoming embedded within the body of the animal once the tracker is released from the arrowhead;

a transmitter being coupled to the tracker housing, the transmitter being positioned on the front side of the tracker housing wherein the transmitter is coplanar with the outer surface of the ferrule of the arrowhead when the tracker is coupled to the arrowhead, the transmitter being configured to wirelessly communicate with a selectable one of a global positioning system unit and a radio frequency receiver unit wherein the transmitter is configured to identify a geographic location of the tracker housing;

a projection being coupled to the tracker housing, the projection extending outwardly from the back side of the tracker housing, the projection being integrally formed with the tracker housing, the projection being tapered to a point wherein the projection is configured to penetrate the body of the animal to secure the tracker housing within the body of the animal when the tracker is released from the arrowhead whereby the tracker is configured to facilitate locating the animal using the geographic location of the tracker housing;

a tracker housing retainer being coupled to the tracker housing, the tracker housing retainer extending outwardly from each lateral side of the pair of lateral sides of the tracker housing wherein the tracker housing retainer physically contacts opposing sides of the tracker slot to form an interference fit between the tracker housing and the ferrule of the arrowhead;

an antenna being coupled to the transmitter, the antenna extending outwardly from the transmitter, the antenna being elongated wherein the antenna is configured to extend outwardly from the body of the animal while the tracker housing is positioned within the body of the animal and wherein the antenna is configured to facilitate the transmitter in wirelessly communicating with the one of the global positioning system unit and the radio frequency receiver unit while the transmitter is embedded within the body of the animal, the antenna being a whip antenna;

an ejector being movably positioned within the arrowhead interior space of the arrowhead, the ejector being operably coupled to the tracker wherein movement of the ejector toward the aft end of the arrowhead releases the tracker from the arrowhead, the ejector having a size being complementary to a size of the tip end opening wherein the ejector is positionable within the arrowhead interior space through the tip end opening, the ejector including:

an ejector top end being configured to be positioned proximate to the tip end opening of the arrowhead before the arrowhead impacts the animal;

a cutout being positioned adjacent to the ejector top end wherein the cutout is aligned with the tracker slot of the arrowhead, the cutout having a shape being complementary to a shape of the tracker housing wherein the tracker housing is positionable within the cutout through the tracker slot, the cutout including:

a sloped upper wall being angled to complement the upper end of the tracker housing wherein the sloped upper wall is in contact with the upper end of the tracker housing and wherein the sloped upper wall is configured to slide downwardly along the upper end of the tracker housing to urge the tracker housing outwardly from the arrowhead when the ejector moves toward the aft end of the arrowhead;

an ejector base end being spaced from the aft end of the arrowhead wherein the ejector is configured to be movable toward the aft end of the arrowhead when the arrowhead moves through the animal;

an acceleration force retainer being positioned proximate to the aft end of the arrowhead, the acceleration force retainer being positioned between the tracker and the aft end of the arrowhead wherein the acceleration force retainer is configured to secure a position of the ejector within the arrowhead interior space while the arrowhead flies toward the animal, the acceleration force retainer being operably coupled to the ejector wherein the acceleration force retainer is configured to release the ejector once the arrowhead impacts the animal to facilitate movement of the ejector toward the aft end of the arrowhead;

an actuator extending outwardly from the ferrule of the arrowhead wherein the actuator is configured to contact the body of the animal when the arrowhead moves through the animal, the actuator being movably coupled to the ferrule of the arrowhead wherein the actuator is configured to move backwardly toward the aft end of the arrowhead when the actuator contacts the body of the animal, the actuator being coupled to the ejector wherein the actuator urges the ejector backwardly toward the aft end of the arrowhead when the actuator moves toward the aft end of the arrowhead; and a switch being coupled to the ejector, the switch being aligned with the transmitter of the tracker when the tracker is coupled to the arrowhead, the switch being in communication with the transmitter wherein the switch turns the transmitter off while the tracker housing is coupled to the arrowhead, the transmitter being configured to be inhibited from wirelessly communicating with the selectable one of the global positioning system unit and the radio frequency receiver unit while the transmitter is turned off, the switch turning the transmitter on once the tracker housing is released from the arrowhead, the transmitter being configured to wirelessly communicate with the selectable one of the global positioning system unit and the radio frequency receiver unit when the transmitter is turned on.

13. The trackable broadhead assembly of claim 12, the actuator further comprising a pair of actuator blades being positioned within the pair of ferrule actuator slots, the pair of ferrule actuator slots having a height exceeding a height of the pair of actuator blades, the pair of actuator blades being coupled to the ejector wherein the pair of actuator blades are configured to slide downwardly from the ferrule actuator slot top end toward the ferrule actuator slot bottom end when the arrowhead moves through the animal to urge the ejector toward the aft end of the arrowhead.

14. The trackable broadhead assembly of claim 13, further comprising a pair of ejector blade slots extending through the ejector, the pair of ejector blade slots being alignable with the pair of ferrule actuator slots, the pair of actuator blades being pivotably coupled to the arrowhead within the pair of ferrule actuator slots and the pair of actuator blades being pivotably coupled to the ejector within the pair of ejector blade slots wherein each actuator blade of the pair of actuator blades is configured to be pivotable upwardly toward the tip end of the arrowhead when each actuator blade of the pair of actuator blades is positioned downwardly against the ferrule actuator slot bottom end to facilitate removal of the arrowhead from the body of the animal.

15. The trackable broadhead assembly of claim 12, the acceleration force retainer further comprising:

a spring finger ledge extending outwardly from an inner surface of the ferrule into the arrowhead interior space; and a plurality of spring fingers, each spring finger of the plurality of spring fingers including:

a spring finger plate being pivotably coupled to and extending downwardly from the ejector base end; and a spring finger lip being coupled to the spring finger plate distally to the ejector base end, the spring finger lip extending outwardly from the spring finger plate wherein the spring finger lip is positionable on to rest on the spring finger ledge, the spring finger plate being configured to pivot inwardly to slide the spring finger lip downwardly past the spring finger ledge.

16. The trackable broadhead assembly of claim 12, the acceleration force retainer further comprising:

a ferrule shear pin aperture extending through the outer surface of the ferrule into the arrowhead interior space;

an ejector shear pin aperture extending into the ejector; and a shear pin being positionable to extend through the ferrule shear pin aperture into the ejector shear pin aperture, the shear pin being configured to secure a position of the ejector before the arrowhead impacts the animal, the shear pin being configured to break when the arrowhead impacts the animal.

17. The trackable broadhead assembly of claim 12, the acceleration force retainer further comprising a rotating indexer mechanism including:

a plurality of indexer guide fingers being coupled to and extending downwardly from the ejector base end of the ejector, the plurality of indexer guide fingers being spaced from each other;

an indexer base being rotatably coupled to the aft end of the ferrule of the arrowhead, the indexer base being positioned within the arrowhead interior space, the indexer base including a plurality of indexer base fingers being configured to be aligned with and physically contacting the plurality of indexer guide fingers to secure a position of the ejector within the arrowhead interior space while the arrowhead flies toward the animal; and an indexer pin being operably coupled to the indexer base wherein the indexer pin is configured to rotate the indexer base in a first direction when the arrowhead is launched toward the animal to align the plurality of indexer base fingers with the plurality of indexer guide fingers while the arrowhead flies toward the animal, the indexer pin being configured to rotate the indexer base in a second direction to position each indexer guide finger of the plurality of indexer guide fingers between respective adjacent pairs of the plurality of indexer base fingers to facilitate downward movement of the ejector toward the aft end of the ferrule.

18. The trackable broadhead assembly of claim 12, the actuator further comprising a pair of fins being coupled to and extending outwardly from the ejector, the pair of fins being positioned on opposing sides of the ejector, the pair of fins extending outwardly from the arrowhead interior space through the pair of ferrule actuator slots wherein the pair of fins are configured to contact the body of the animal when the arrowhead impacts the animal, the pair of ferrule actuator slots having a height exceeding a height of the pair of fins wherein the pair of fins are configured to slide downwardly from the ferrule actuator slot top end to the ferrule actuator slot bottom end when the arrowhead moves through the animal, the pair of fins urging the ejector downwardly toward the aft end of the arrowhead when the pair of fins slide downwardly along the pair of ferrule actuator slots.

* * * * *